US012571610B2

(12) United States Patent
Hamilton

(10) Patent No.: US 12,571,610 B2
(45) Date of Patent: Mar. 10, 2026

(54) OPTICAL SIGHT FOR FIREARM WITH INTEGRAL REAR SIGHT

(71) Applicant: Sturm, Ruger & Company, Inc., Southport, CT (US)

(72) Inventor: Gary Hamilton, South Windsor, CT (US)

(73) Assignee: Sturm, Ruger & Company, Inc.

( * ) Notice: Subject to any disclaimer, the term of this patent is extended or adjusted under 35 U.S.C. 154(b) by 62 days.

(21) Appl. No.: 18/654,915

(22) Filed: May 3, 2024

(65) Prior Publication Data

US 2024/0353199 A1 Oct. 24, 2024

Related U.S. Application Data

(63) Continuation-in-part of application No. 17/833,060, filed on Jun. 6, 2022, now Pat. No. 11,976,901.

(60) Provisional application No. 63/514,638, filed on Jul. 20, 2023, provisional application No. 63/197,855, filed on Jun. 7, 2021.

(51) Int. Cl.
*F41G 1/34* (2006.01)
*F41G 1/14* (2006.01)

(52) U.S. Cl.
CPC ..... *F41G 1/345* (2013.01); *F41G 1/14* (2013.01)

(58) Field of Classification Search
CPC ..... F41G 1/30
USPC ..... 42/113
See application file for complete search history.

(56) References Cited

U.S. PATENT DOCUMENTS

| | | | |
|---|---|---|---|
| 2,590,954 | A | 4/1952 | Gerber |
| 2,780,130 | A | 2/1957 | Mauer |
| 2,904,887 | A | 9/1959 | Kuhlenkamp |
| 3,137,769 | A | 6/1964 | Yates et al. |
| 3,263,566 | A | 8/1966 | Eglin et al. |
| 3,386,172 | A | 6/1968 | Wossagk |
| 3,498,725 | A | 3/1970 | Burrows et al. |
| 3,524,710 | A | 8/1970 | Rickert |
| 3,638,321 | A | 2/1972 | Eglin |
| 3,671,100 | A | 6/1972 | Bushman et al. |
| 3,836,263 | A | 9/1974 | Rickert et al. |

(Continued)

FOREIGN PATENT DOCUMENTS

| | | | |
|---|---|---|---|
| CN | 201081611 | Y | 7/2008 |
| CN | 204807800 | U | 11/2015 |

(Continued)

*Primary Examiner* — Samir Abdosh
(74) *Attorney, Agent, or Firm* — The Belles Group, P.C.

(57) ABSTRACT

A passively and naturally illuminated optical reflex sighting system for a firearm in one embodiment includes a housing configured for detachable coupling to the firearm, an optical lens supported by the housing, a fiber optic element, and a light-transmissible cover enclosing the fiber optic element. The cover and fiber optic element are in visual communication with ambient light which is collected by fiber optic element through the cover. In operation, the fiber optic element absorbs ambient light and generates a reticle on the lens for aiming the firearm. A red or other colored dot reticle may be projected on the lens in some embodiments. No onboard artificial light is used to illuminate the fiber optic element. The housing may include an integrally-formed rear sight which is alignable with a front sight to aim the firearm independently of the fiber optics generated reticle.

18 Claims, 32 Drawing Sheets

(56) References Cited

U.S. PATENT DOCUMENTS 3,905,708 A 9/1975 Steck, III
3,915,552 A 10/1975 Rickert
3,942,901 A 3/1976 Ekstrand
4,030,203 A 6/1977 Ackerman
4,030,839 A 6/1977 Rickert
4,432,626 A 2/1984 Ohtake
4,658,139 A 4/1987 Brennan et al.
4,764,011 A 8/1988 Goldstein
4,805,313 A 2/1989 Stocker et al.
5,369,888 A 12/1994 Kay et al.
5,373,644 A 12/1994 DePaoli
5,579,165 A 11/1996 Michel et al.
5,625,954 A 5/1997 DePaoli
5,653,034 A * 8/1997 Bindon ..... G02B 23/105 33/297
5,924,234 A * 7/1999 Bindon ..... G02B 27/34 33/298
6,085,427 A 7/2000 Persson
6,327,806 B1 12/2001 Paige
6,519,889 B1 2/2003 Schlierbach et al.
6,568,118 B1 5/2003 Teetzel
6,807,742 B2 10/2004 Schick
7,219,370 B1 5/2007 Teetzel et al.
7,296,358 B1 11/2007 Murphy et al.
7,325,318 B2 2/2008 Roes
7,525,203 B1 4/2009 Racho
7,574,810 B1 8/2009 LoRocco
7,634,866 B2 * 12/2009 Javorsky ..... F41G 1/12 42/111
D612,006 S 3/2010 Kohler
7,765,731 B1 8/2010 Liebig
7,814,669 B2 10/2010 Kingsbury
7,855,778 B2 12/2010 Yung et al.
7,872,747 B2 1/2011 Gerlach
8,006,428 B2 8/2011 Moore et al.
8,047,118 B1 11/2011 Teetzel et al.
8,087,196 B2 1/2012 Jung et al.
8,091,268 B2 1/2012 York
8,109,031 B2 2/2012 Tang et al.
8,166,698 B2 5/2012 Raviv et al.
8,186,093 B1 5/2012 Chung
8,215,050 B2 7/2012 Elpedes et al.
8,228,500 B2 7/2012 Tsai
8,364,002 B2 1/2013 Schick et al.
D676,096 S 2/2013 Gambino
8,393,109 B2 3/2013 Gilmore
8,474,173 B2 7/2013 Matthews et al.
8,484,881 B2 7/2013 Lindlau et al.
8,578,646 B2 11/2013 Joannes
8,599,481 B2 12/2013 Thomas et al.
8,671,611 B2 3/2014 Ostergren et al.
D704,296 S 5/2014 Cheng
D704,297 S 5/2014 Cheng
8,749,884 B2 6/2014 Jahromi
8,879,146 B2 11/2014 LoRocco et al.
8,966,805 B2 3/2015 Koesler et al.
8,984,795 B2 3/2015 Jung et al.
8,997,393 B2 4/2015 Bar Yona
9,046,320 B2 6/2015 Keng et al.
9,057,584 B2 6/2015 Chung
9,062,936 B2 6/2015 Zimmer
9,069,172 B1 6/2015 Morley
D741,446 S 10/2015 Cheng et al.
9,163,902 B1 10/2015 Cheng et al.
9,164,269 B1 10/2015 Jahromi
D742,471 S 11/2015 Golovaty
D747,431 S 1/2016 Cheng et al.
D752,699 S 3/2016 Coffman
9,285,186 B1 3/2016 Di Veroli et al.
9,291,808 B2 3/2016 Feinberg
9,316,460 B2 4/2016 Cheng et al.
9,389,045 B2 7/2016 Reichert et al.
9,411,148 B2 8/2016 Szapiel
9,417,037 B2 8/2016 Jahromi
9,423,212 B2 8/2016 Campean
9,441,915 B2 9/2016 Zimmer
9,453,706 B1 9/2016 Crispin
9,506,723 B2 11/2016 Teetzel et al.
9,574,853 B2 2/2017 Crispin
D781,990 S 3/2017 Cheng et al.
9,587,910 B1 * 3/2017 Jackson ..... F41G 1/10
9,593,906 B1 3/2017 Oz
9,593,907 B2 3/2017 Regan et al.
9,612,068 B2 4/2017 Burden
9,696,114 B1 7/2017 Cabrera et al.
9,752,853 B2 9/2017 Teetzel et al.
9,778,452 B2 10/2017 Mochinushi
9,791,244 B2 10/2017 Maryfield et al.
9,797,688 B2 10/2017 Kennair, Jr.
9,869,526 B1 1/2018 Cheng et al.
9,921,034 B2 3/2018 Jakob et al.
9,958,234 B2 5/2018 Campean
10,060,702 B2 8/2018 Crispin
10,073,277 B2 9/2018 Plumb
10,094,638 B2 10/2018 Grace, Jr.
10,126,099 B1 11/2018 Hammond et al.
D837,927 S 1/2019 Trulsson
10,175,029 B2 1/2019 Teetzel et al.
10,234,238 B1 3/2019 Thomas et al.
10,240,898 B2 3/2019 Crispin
D846,689 S 4/2019 Cheng et al.
D846,690 S 4/2019 Cheng et al.
D846,691 S 4/2019 Cheng et al.
D847,292 S 4/2019 Hoff
D848,567 S 5/2019 Soejima
D849,180 S 5/2019 Cheng et al.
10,302,393 B2 * 5/2019 Grace, Jr. ..... H10N 10/17
10,337,837 B2 7/2019 Keller et al.
10,352,654 B2 7/2019 Costet et al.
D856,458 S 8/2019 Cheng et al.
10,451,383 B1 * 10/2019 Stephenson ..... F41G 1/345
10,473,427 B1 11/2019 Sereday et al.
10,480,900 B2 11/2019 York et al.
10,502,530 B1 12/2019 Jahromi
D872,219 S 1/2020 Horton et al.
10,551,149 B2 2/2020 Teetzel et al.
10,557,687 B2 2/2020 Teetzel et al.
10,563,955 B2 2/2020 Pniel et al.
D877,847 S 3/2020 Vail
D881,319 S 4/2020 Larsson et al.
D881,320 S 4/2020 Larsson et al.
D882,716 S 4/2020 Connolly
10,684,096 B2 6/2020 Williams
10,704,862 B2 7/2020 Chung
10,705,355 B2 7/2020 Qi et al.
10,731,947 B2 8/2020 Grace et al.
D895,051 S 9/2020 Crispin et al.
D897,483 S 9/2020 Cheng et al.
10,782,099 B2 9/2020 Zimmer
D900,273 S 10/2020 Cheng et al.
10,801,812 B2 10/2020 Buchsbaum
10,830,560 B2 11/2020 Barnett et al.
10,837,737 B1 11/2020 Wright
10,876,816 B2 12/2020 Campbell
10,907,932 B2 * 2/2021 Curry ..... F41G 1/30
10,942,006 B2 3/2021 VanBecelaere et al.
11,112,214 B2 9/2021 Niswander et al.
11,644,275 B2 * 5/2023 Kennedy ..... F41G 1/345 42/113
2003/0012015 A1 1/2003 Schiller et al.
2005/0138824 A1 * 6/2005 Afshari ..... F41G 1/467 33/265
2007/0227018 A1 * 10/2007 Ellig ..... F41G 1/467 33/265
2008/0144181 A1 6/2008 Pniel
2009/0193705 A1 8/2009 LoRocco
2011/0102785 A1 * 5/2011 Tsai ..... G02B 23/105 356/251
2011/0138639 A1 6/2011 Kingsley et al.
2012/0151816 A1 6/2012 Kleck et al.
2012/0180329 A1 * 7/2012 Priebe ..... F41G 1/14 33/265
2014/0041277 A1 2/2014 Hamilton
2014/0360077 A1 12/2014 Miller et al.

(56) References Cited

U.S. PATENT DOCUMENTS

| | | | | |
|---|---|---|---|---|
| 2016/0356573 | A1 | 12/2016 | Berlips et al. | |
| 2017/0276456 | A1 | 9/2017 | Campbell | |
| 2018/0073840 | A1 | 3/2018 | Kristoffersen | |
| 2018/0142991 | A1 | 5/2018 | Rogers et al. | |
| 2018/0195835 | A1* | 7/2018 | Crispin | F41G 1/30 |
| 2018/0372448 | A1* | 12/2018 | Noskowicz | F41G 1/38 |
| 2019/0078857 | A1* | 3/2019 | Vergara | H10N 10/853 |
| 2019/0249958 | A1 | 8/2019 | Teetzel et al. | |
| 2019/0277600 | A1 | 9/2019 | Larsson et al. | |
| 2019/0323795 | A1 | 10/2019 | Zimmer | |
| 2019/0376766 | A1 | 12/2019 | Fruechtel | |
| 2020/0025518 | A1 | 1/2020 | Nackel et al. | |
| 2020/0025522 | A1 | 1/2020 | Zimmer | |
| 2020/0232759 | A1 | 7/2020 | York et al. | |
| 2020/0240748 | A1 | 7/2020 | Connolly | |
| 2020/0271419 | A1 | 8/2020 | Grace | |
| 2020/0355466 | A1 | 11/2020 | Szapiel | |
| 2020/0404194 | A1 | 12/2020 | Buchsbaum | |
| 2021/0033369 | A1 | 2/2021 | Shawley et al. | |
| 2021/0055536 | A1 | 2/2021 | DeAngelis | |
| 2021/0172704 | A1 | 6/2021 | Nackel et al. | |
| 2021/0325146 | A1* | 10/2021 | Thomele | F41G 1/065 |
| 2022/0026175 | A1* | 1/2022 | Chavez | F41G 1/30 |
| 2022/0034629 | A1* | 2/2022 | Hamilton | F41G 1/30 |
| 2022/0170718 | A1 | 6/2022 | Reese et al. | |
| 2024/0110766 | A1* | 4/2024 | Sheets, Jr. | F41G 11/003 |

FOREIGN PATENT DOCUMENTS

| | | | | |
|---|---|---|---|---|
| CN | 107726255 | A | 2/2018 | |
| CN | 207741635 | U | 8/2018 | |
| EP | 0345744 | A3 | 8/1990 | |
| EP | 0651226 | B1 | 6/1999 | |
| EP | 0651225 | B1 | 1/2000 | |
| EP | 2738511 | A1 | 6/2014 | |
| EP | 2943736 | B1 | 5/2017 | |
| EP | 3042143 | B1 | 1/2020 | |
| EP | 3071921 | B1 | 1/2020 | |
| EP | 3637036 | A1 | 4/2020 | |
| EP | 3667392 | A1 | 6/2020 | |
| EP | 3943872 | A1 * | 1/2022 | F41G 1/06 |
| ES | 2293731 | T3 | 3/2008 | |
| FR | 2055807 | A1 | 4/1971 | |
| GB | 765061 | A | 1/1957 | |
| IL | 156560 | A | 11/2008 | |
| IL | 193091 | A | 10/2011 | |
| JP | 5371521 | B2 | 12/2013 | |
| JP | 5638991 | B2 | 12/2014 | |
| WO | 2022/005439 | A1 | 1/2022 | |

* cited by examiner

OPTICAL SIGHT FOR FIREARM WITH INTEGRAL REAR SIGHT

CROSS-REFERENCE TO RELATED APPLICATIONS

The present application is a continuation-in-part of U.S. patent application Ser. No. 17/833,060 filed Jun. 6, 2022, which claims the benefit of priority to U.S. Provisional Application No. 63/197,855 filed Jun. 7, 2021. The present application also claims the benefit of U.S. Provisional Application. No. 63/514,638 filed Jul. 20, 2023. The foregoing applications are all incorporated herein by reference in their entireties.

BACKGROUND

The present invention generally relates to firearms, and more particularly to a passively and naturally illuminated reflex sighting system for firearms which uses available ambient light to generate a reticle for aiming.

A recent trend in the firearms industry is to attach an electrically-powered optical based illuminated sighting system to a wide variety of firearm platforms. These sights typically offer fast target acquisition, high contrast colored reticles (dots), and a parallax free sight picture. A red dot reflex optic is commonly used; however, other colors are available. Optical sights are distinguishable from the many forms of lighted sights that do not have an optical lens element onto which the dot reticle is projected by an electrically powered artificial illumination source (e.g., light). Some optical sight designs, however, are complex and relatively expensive resulting in a barrier to entry for some users seeking a more affordable sight option.

In addition, the bulky size of the housing required for an artificial illuminated reflex sight which must accommodate both the light source and its electric power source (e.g., battery) generally prohibits their use on smaller format concealed carry firearms such as compact semi-automatic pistols. Artificially illuminated reflex sights heretofore generally are restricted for use on larger size pistols and too impractical by nature for true concealed carry firearm usage. Although some users of such smaller pistols might prefer a dot reticle reflex sight, that option has not generally been available particularly at an affordable pricing point.

A need therefore exists for a reflex type sight which is affordable for all users, and which is adapted for use in some embodiments on smaller concealed carry type pistols.

SUMMARY

A passive natural ambient light illuminated reflex optical sighting system disclosed herein offers a simplified and affordable alternative to the foregoing more complex artificially illuminated reflex sighting systems without the complexities and expense of past designs. No onboard artificial illumination source (i.e. light) on either the sight or firearm is used to illuminate the fiber optic element in the present passively illuminated sight. In addition, the present ambient light illuminated reflex sighting system is also amenable for use with smaller concealed carry firearms such as pistols in some embodiments since the reflex sight housing can be made smaller than larger traditional power illuminated reflex sight housing because the illumination source (LED-light emitting diodes or other) and its electric power source (e.g., batteries) are omitted in some embodiments. This advantageously reduces the bulk and size of traditional battery-powered reflex sight housings with artificial lighting such as those used in the past making the present passive natural ambient-lighted reflex sight usable for both larger and smaller size firearms.

The present passively illuminated sighting system in one embodiment comprises a dot reticle reflex sight which utilizes a natural light gathering illumination element, which may be formed by a polymeric fiber optic element in one embodiment. In one preferred but non-limiting embodiment, the fiber optic element is therefore not illuminated by an electrically powered artificial light source onboard the sight or firearm. Instead, the element is configured and designed to collect and utilize only available ambient light from the environment (e.g., solar) surrounding the firearm alone to generate the dot reticle on the lens.

The intensity of the reticle produced on the lens by the present ambient-lighted reflex sight may be variable dependent upon the amount of ambient light available. The present fiber optic element is designed to provide a reticle of adequate intensity even when ambient light levels are low (e.g., dusk or dawn). The dot reticle of the present reflex sight may be red in one embodiment; however, other colors (e.g., green, etc.) may used by varying the color of the fiber optic element and/or the reflective coating on the lens element of the present optical reflex sight.

In one embodiment, the ambient light illuminated reflex optical sighting system generally comprises the housing detachably coupleable and mountable to a portion of the body of the firearm, a lens supported by the housing, a fiber optic element supported by the housing, and a light-transmissible cover at least partially enclosing the element for protection but constructed to transmit natural ambient light therethrough to the fiber optic element. The cover may be clear plastic in one non-limiting implementation.

The fiber optic element may be formed from extruded fiber optic rod and may have numerous configurations selected to optimize its light gathering and absorbing capabilities. In one embodiment, the fiber optic element may include a light-absorbing circuitous portion or section which may be formed by coiled section of the fiber optic rod having a multiple loop configuration comprised of two or more concentrically arranged and aligned loops of the optical rod. The light-absorbing coiled section advantageously increases the available surface area of the fiber optic element and concomitantly the amount of ambient light which can be absorbed in the available small footprint or space within the housing of the sighting system. The fiber optic element further comprises a light-emitting end section aimed at the lens for projecting the reticle beam and resultant reticle thereon, which may be dot shaped in some implementations. The end section may be formed contiguously with the coiled section as a unitary part of a single monofilament fiber optic rod such that the absorbed ambient light is transmitted internally through the entire fiber optic rod.

One goal of the present dot reticle sight design is to simplify the overall reflex sighting system and size of the reflex sight housing while maximizing the light gathering capability of the fiber optic element. The housing is specially configured to increase the amount of ambient light which can be collected and absorbed by the fiber optic element. Accordingly, in one embodiment, the housing may be configured such that ambient light can enter the fiber optic element from a plurality of sides (e.g., 2 or more sides) through the sight housing to enhance collection of light and corresponding light beam output of the fiber optic rod to form the reticle on the lens. In one implementation, light may enter the fiber optic element via a plurality of light collection and transmission windows. One non-limiting design may allow light to reach the fiber optic element from 4 or more sides such as via front, lateral, and top light collection windows of the housing.

The fiber optic element may be enclosed by a light-transmissible (e.g., transparent/clear) protective cover detachably mounted to the housing of the sighting system. The fiber optic element and cover may be received in an upwardly and forwardly open light-gathering cavity of the housing. The cover visually/optically communicates (i.e. transmits) ambient light received through the windows of the housing to the fiber optic element which absorbs the light to produce the dot reticle on the lens. The terms "visual or optical communication" (including various forms and tenses of those words) connotes that a light transmission path is created which is physically unobstructed. The ambient light illuminated reticle sight has sufficient light gathering abilities by design to be is usable in a variety of ambient lighting conditions at different time of the day and/or weather conditions (e.g., cloudy or overcast skies as well sunny conditions).

In one embodiment, the reflex sight system may be configured for mounting and use on a reciprocating slide of a semi-automatic pistol which may be the firearm. However, the sight may be configured for mounting to other types of handguns (e.g., revolvers) or long guns (e.g., rifles and shotguns).

According to one aspect, a natural or passively illuminated optical reflex sighting system for a firearm which utilizes only ambient light as the source of illumination comprises: a housing configured for detachable mounting to the firearm and comprising a plurality of light collection and transmission windows; a lens supported by the housing; a fiber optic element supported in the housing, the fiber optic element configured and operable to absorb ambient light; and a light-transmissible cover enclosing the fiber optic element, the cover and fiber optic element being in communication with the windows in the housing which collect and transmit the ambient light to the fiber optic element; wherein the fiber optic element is configured to absorb the ambient light and generate a reticle on the lens for aiming the firearm.

In another aspect, a firearm with passively illuminated optical reflex sighting system comprises: a firearm body defining a sight mounting section; an optical reflex sight comprising: a housing detachably coupled to the sight mounting section of the firearm body, the housing comprising a light-gathering cavity and a plurality of light collection and transmission windows in visual communication with the cavity; a lens supported by the housing; a fiber optic element supported in the cavity of the housing, the fiber optic element comprising a light-absorbing circuitous section and contiguous light-emitting end section aimed at the lens; and a light-transmissible cover enclosing the fiber optic element, the cover and light-absorbing circuitous section of the fiber optic element being in optical communication with the windows in the housing which collect and transmit the ambient light to the fiber optic element through the cover; wherein the fiber optic element is configured to absorb the ambient light from the windows and generate a reticle on the lens for aiming the firearm with no onboard artificial light which illuminates the fiber optic element.

In another aspect, a method for providing a firearm with a passively illuminated optical reflex sighting system comprises: providing a reticle reflex sight comprising a housing supporting a lens, and fiber optic element including a light-absorbing circuitous section and a light-emitting end portion aimed at the lens; mounting the sight on the firearm; absorbing natural ambient light via the light-absorbing circuitous section of the fiber optic element; and generating a reticle on the lens via the light-emitting end portion of the fiber optic element; wherein there is no onboard artificial light used to illuminate the fiber optic element.

BRIEF DESCRIPTION OF THE DRAWINGS

The present invention will become more fully understood from the detailed description and the accompanying drawings, wherein like elements are labeled similarly and in which.

Figure 1:
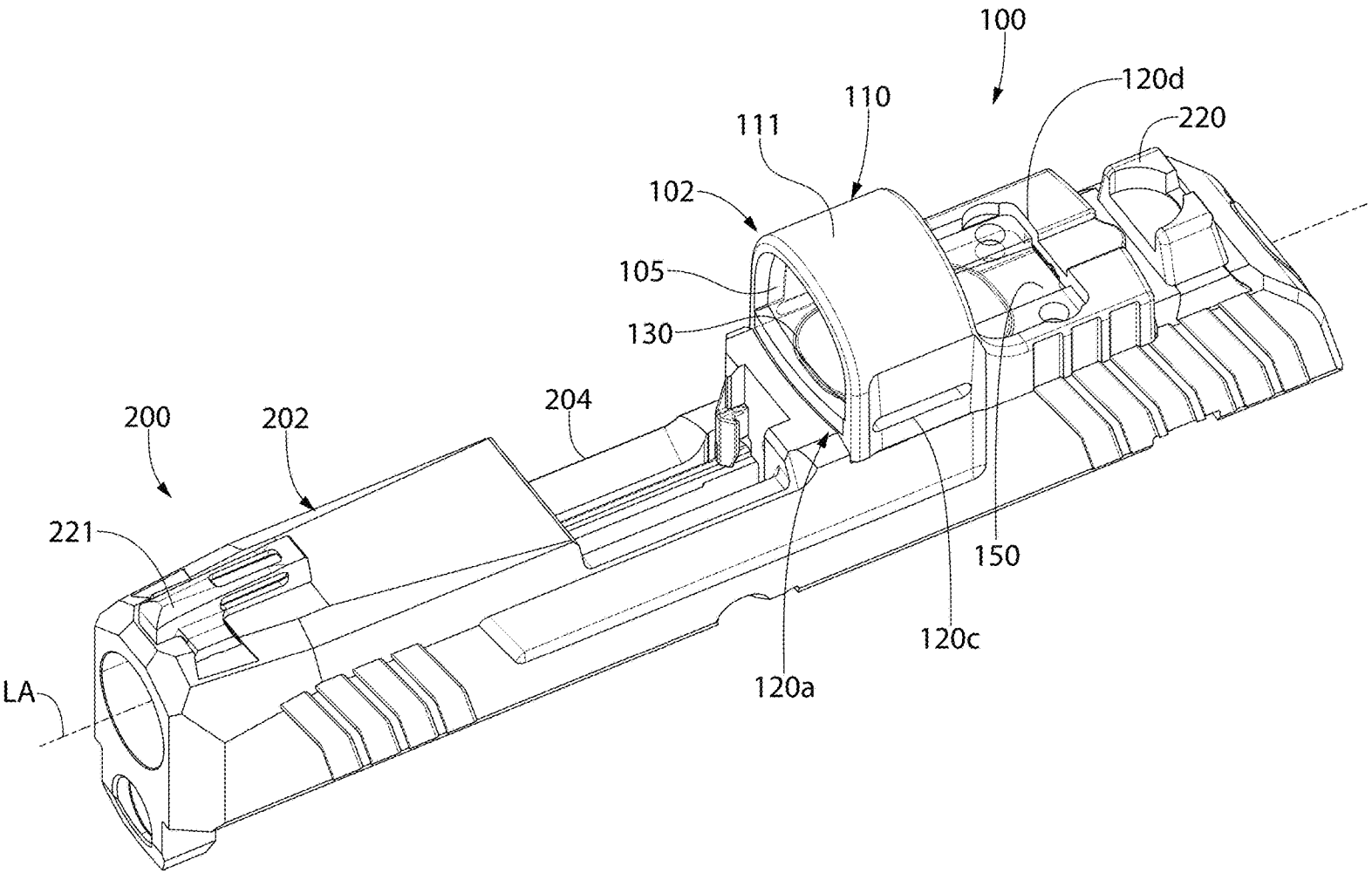
FIG. 1 is a first top perspective view of a first embodiment of a body portion of a firearm including a first embodiment of a naturally illuminated optical reflex sight according to the present disclosure.
Figure 2:
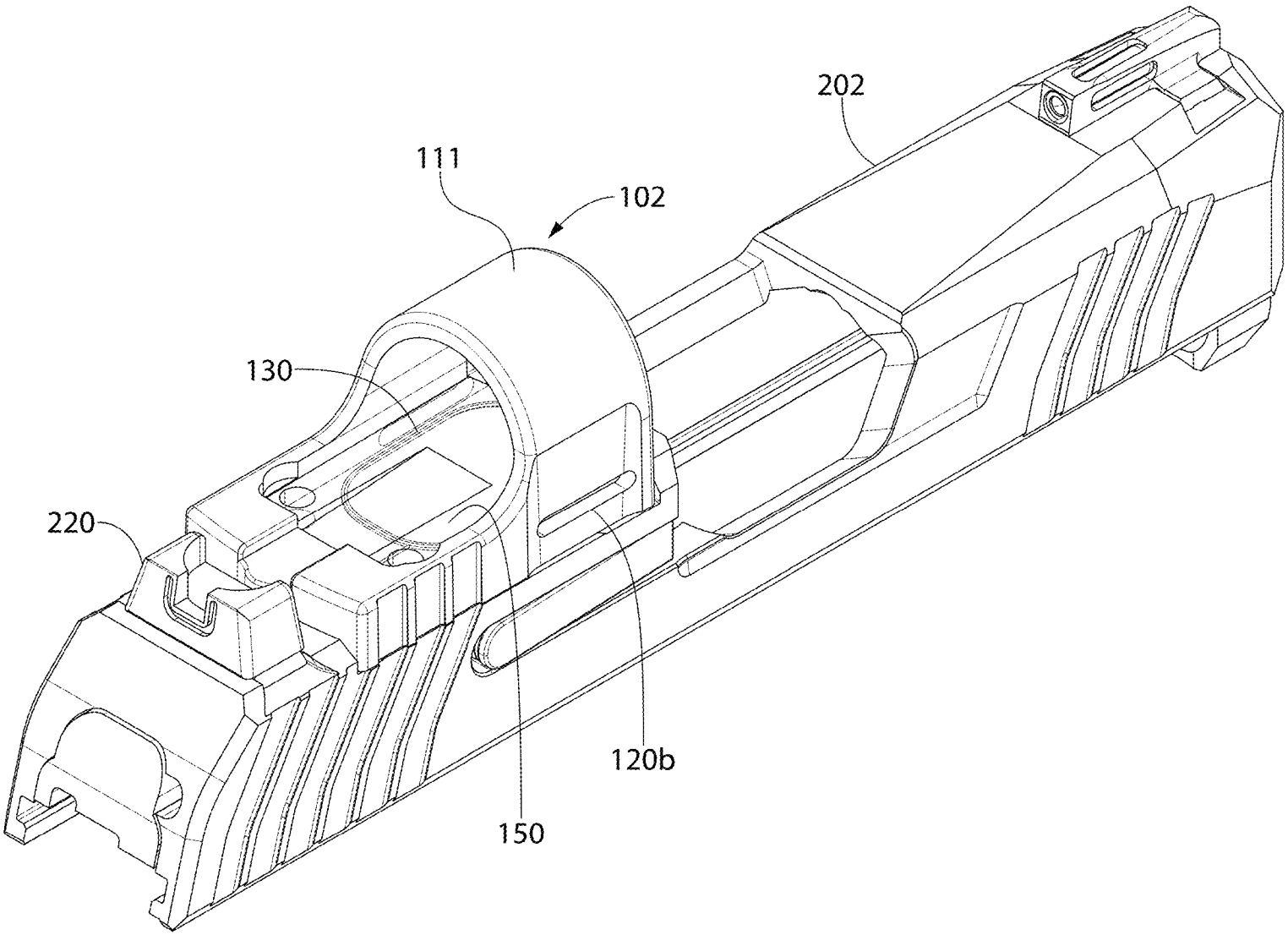
FIG. 2 is a second top perspective view thereof.
Figure 3:
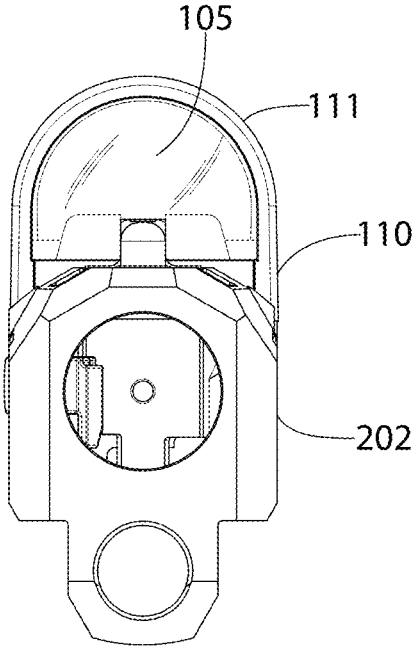
FIG. 3 is front view thereof.
Figure 4:
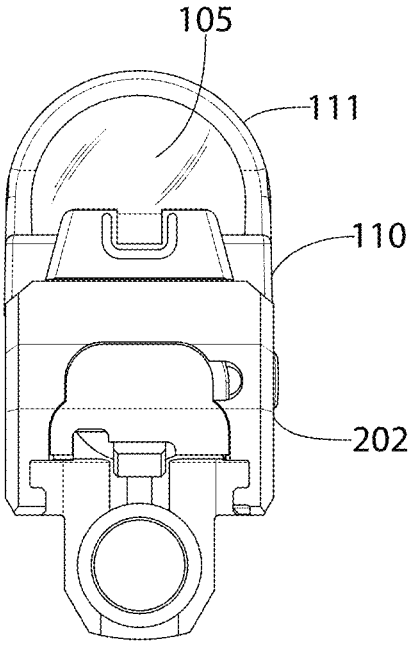
FIG. 4 is a rear view thereof.
Figure 5:
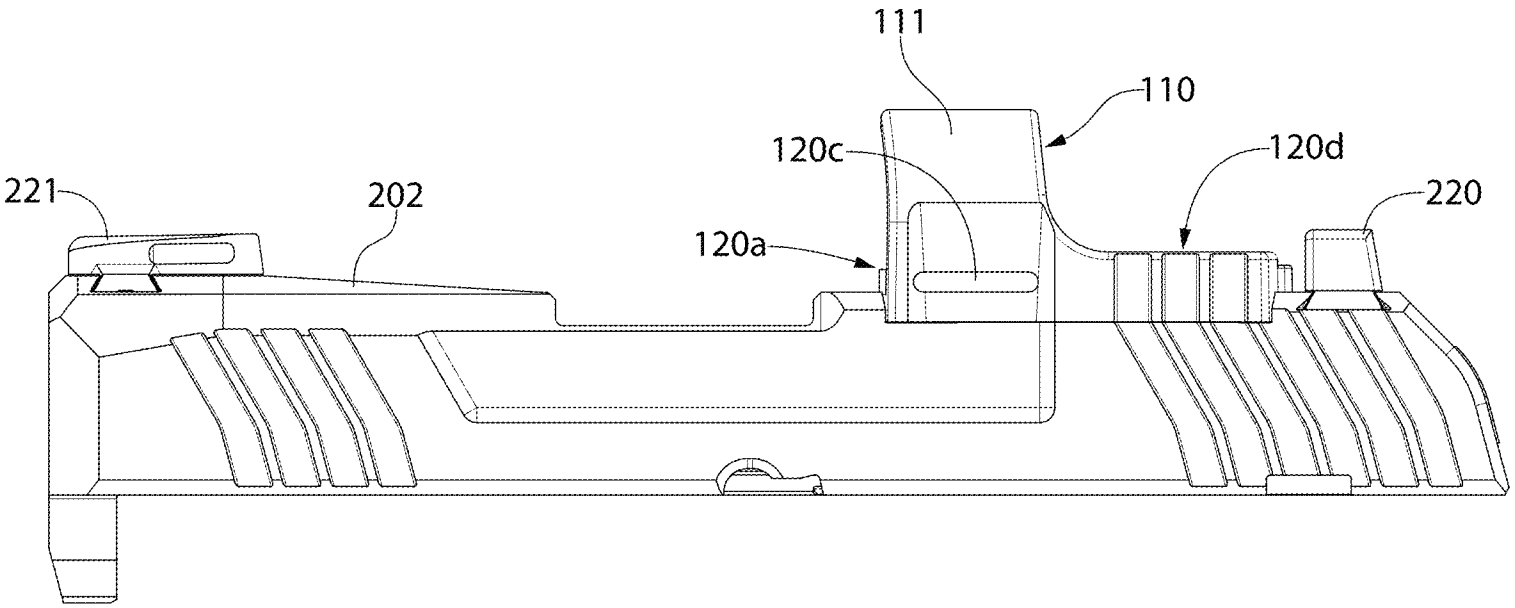
FIG. 5 is a left lateral side view thereof.
Figure 6:
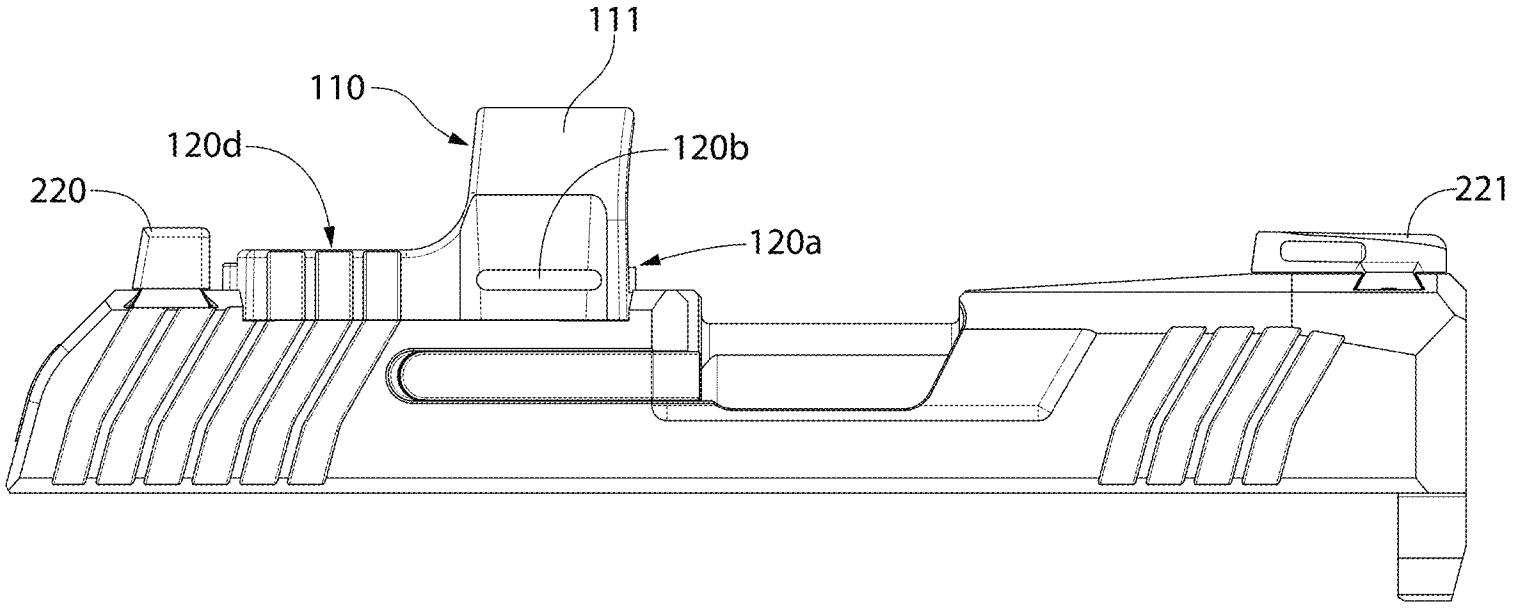
FIG. 6 is a right lateral side view thereof.
Figure 7:
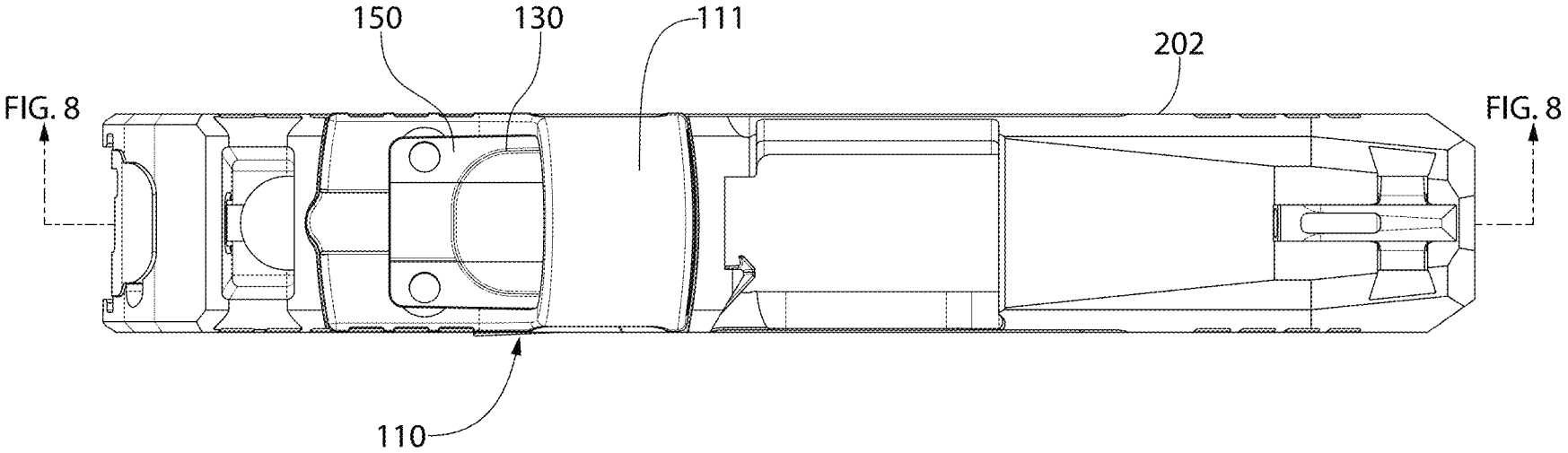
FIG. 7 is a top view thereof.
Figure 8:
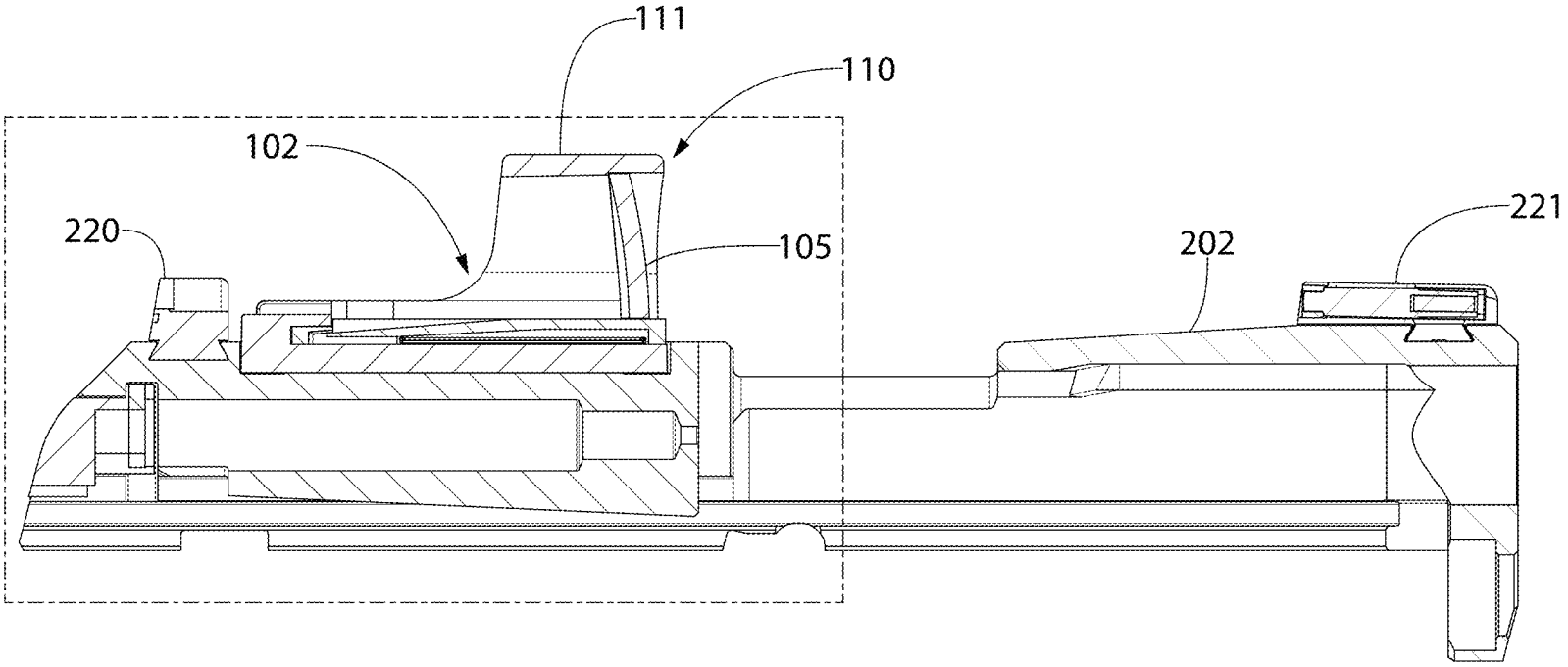
FIG. 8 is a right lateral side cross sectional view thereof.
Figure 9:
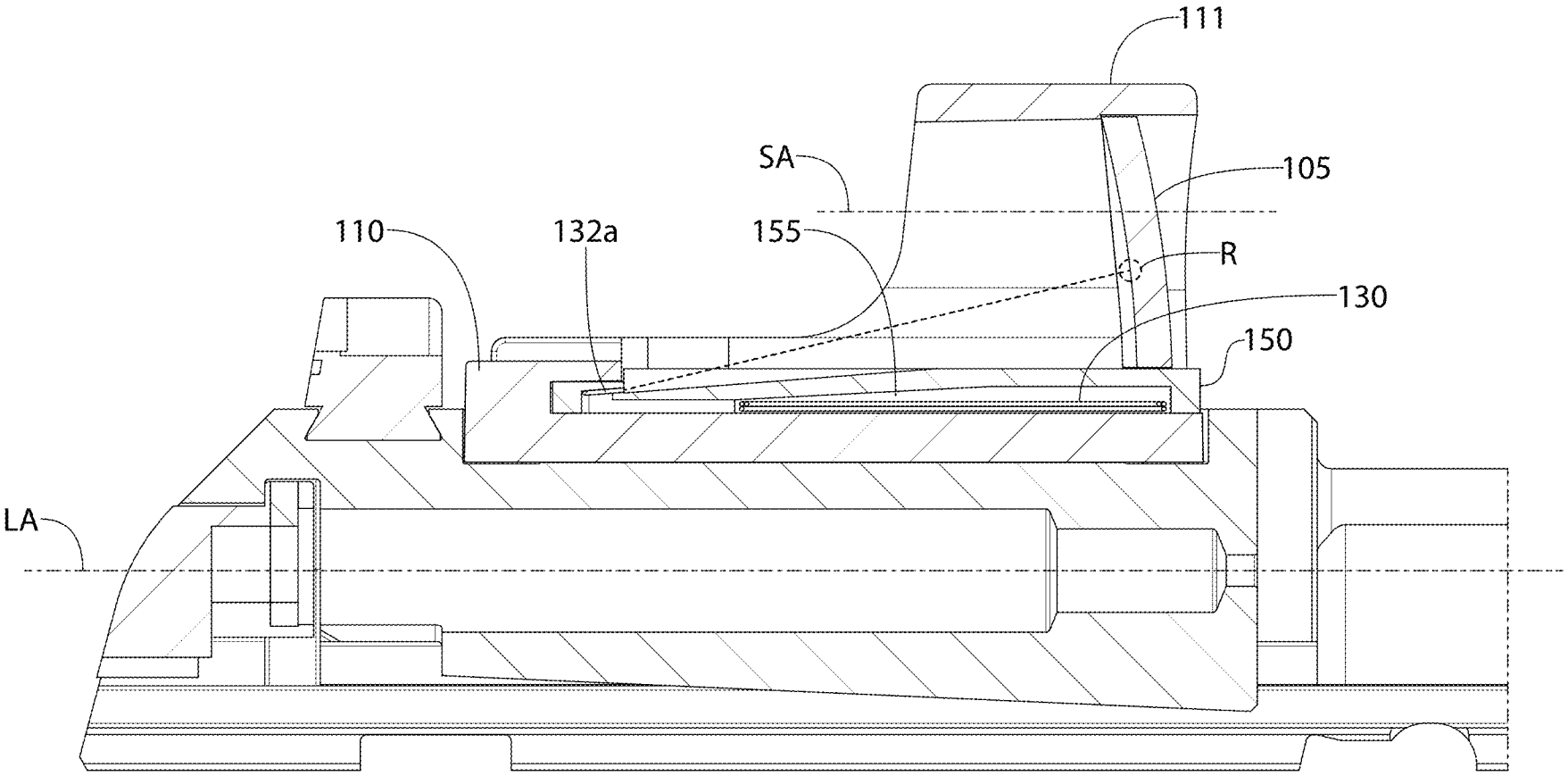
FIG. 9 is an enlarged detail taken from FIG. 8 showing the reticle beam path (dashed lines) and resultant reticle produced on the lens.

All drawings are schematic and not necessarily to scale. Parts given a reference numerical designation in one figure may be considered to be the same parts where they appear in other figures without a numerical designation for brevity unless specifically labeled with a different part number and described herein. References herein to a whole figure number herein which may comprise multiple figures with the same whole number but including an alphabetical suffix shall be construed to be a general reference to all those figures sharing the same whole number, unless otherwise indicated.

DETAILED DESCRIPTION

The features and benefits of the invention are illustrated and described herein by reference to non-limiting exemplary ("example") embodiments. This description of exemplary embodiments is intended to be read in connection with the accompanying drawings or photos, which are to be considered part of the entire written description. Accordingly, the disclosure expressly should not be limited to such exemplary embodiments illustrating some possible non-limiting combination of features that may exist alone or in other combinations of features disclosed herein.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

FIGS. 1-16 show a first embodiment of an optical reflex sighting system naturally and passively illuminated by ambient light according to the present disclosure. The sighting system may be a dot reticle type illuminated sight which does not include an electrically-powered illumination source such as a light (e.g., LED or other) onboard the sight or firearm to illuminate the fiber optic element and generate the reticle. The present optical reflex sight functions on the natural ambient light absorption and transmission features of the sight further described herein to produce and project the reticle on the aiming lens of the sight. This distinguishes the present passively illuminated fiber-optic based reticle reflex sight from such conventional electrically powered and artificially illuminated reticle reflex sights of the past.

The present non-limiting embodiment of the reflex sight system 100 design according to the present disclosure includes a dot reticle optical reflex sight 102 which may be generally comprised of four main components: a lens 105; a housing 110 configured for mounting to the firearm; the fiber optic element 130 configured and arranged for ambient light gathering and absorption; and a preferably clear/transparent light-transmissible cover 150 for the light gathering element which offers protection from the environment, dust/debris, and damage during handling of the firearm.

Figure 30:
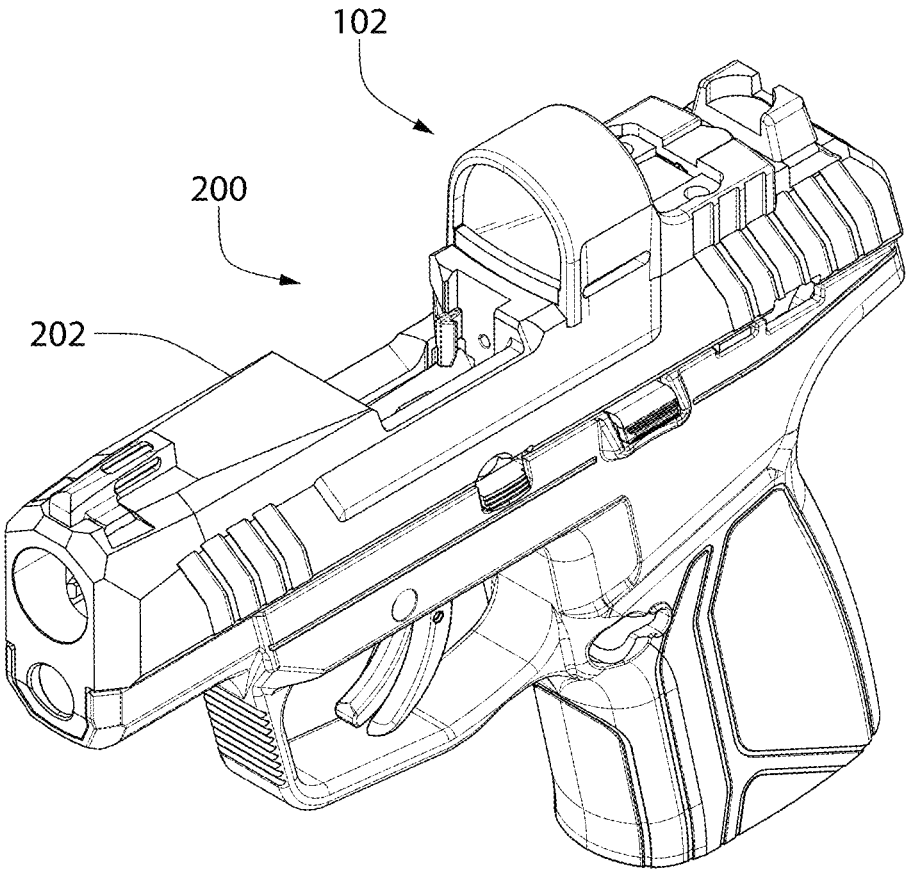
FIG. 30 is a perspective view of the entire firearm of FIG. 1 with the first embodiment of the sight mounted thereon.

The dot reticle optical reflex sight 102 may be mounted to any portion and type of firearm 200 including a handgun such as semi-automatic pistol 200 shown herein (see, e.g., FIG. 30), or a long gun (e.g., carbine, rifle, or shotgun). Pistol 200 includes a grip frame 206, reciprocating slide 202 which moves rearward and forward to cycle the action after firing in a well known manner for unloading the spent cartridge case and chambering a fresh cartridge from the magazine. The spent cartridge case is extracted from the chamber and ejected through the ejection port 204.

The sight housing 110 in the present naturally-illuminated optical reflex sight design serves several functions. The first is to provide a mounting feature to attach the sight unit to a firearm. The second is to provide a locating and mounting surface for the lens. The third is to locate and support the fiber optic element 130 and cover 150 assembly.

Housing 110 may have a horizontally/longitudinally elongated body defining a sight axis SA oriented parallel to longitudinal axis LA of the firearm when mounted thereon. Longitudinal axis LA is defined by the internal axial bore of the barrel of the firearm through which the projectile (e.g., bullet, etc.) travels when the firearm is discharged. The housing comprises an open front end 112, rear end 113, right lateral side 114*a*, and left lateral side 114*b*, and closed bottom 116. The right and left lateral sides are defined by right and left parallel sidewalls 121*a*, 121*b*.

The body of housing 110 comprises a horizontal longitudinally/axially elongated base portion 117 configured for detachable mounting to the firearm, and an upright vertical lens frame portion 111 projecting upwardly therefrom and configured for mounting the lens thereto.

Any suitable means may be used for detachably coupling and mounting the base portion 117 of the sight housing to the firearm. In one non-limiting embodiment, threaded fasteners 118 may be used for coupling the base portion to a suitable structure or portion of the firearm which may be a stationary member (e.g., frame or chassis) or a movable member (e.g., reciprocating slide of the firearm action). In one embodiment, the base portion 117 may be configured for detachable coupling and mounting to a complementary configured substantially flat sight mounting section 203 of the body of the firearm 200 which defines an interface for attaching the sight 102 thereto. In one embodiment, the sight mounting section 203 of the firearm body may be formed on the top surface of the reciprocating slide 202 of semi-automatic pistol 200 as shown in the non-limiting illustrated embodiment. The bottom 116 of base portion 117 may be flat to define a flat-to-flat interface between the slide and sight housing 110 in one implementation. The fiber optic reflex sight 102 may be mounted rearward of the cartridge ejection port 204 formed in the slide.

Figure 15:
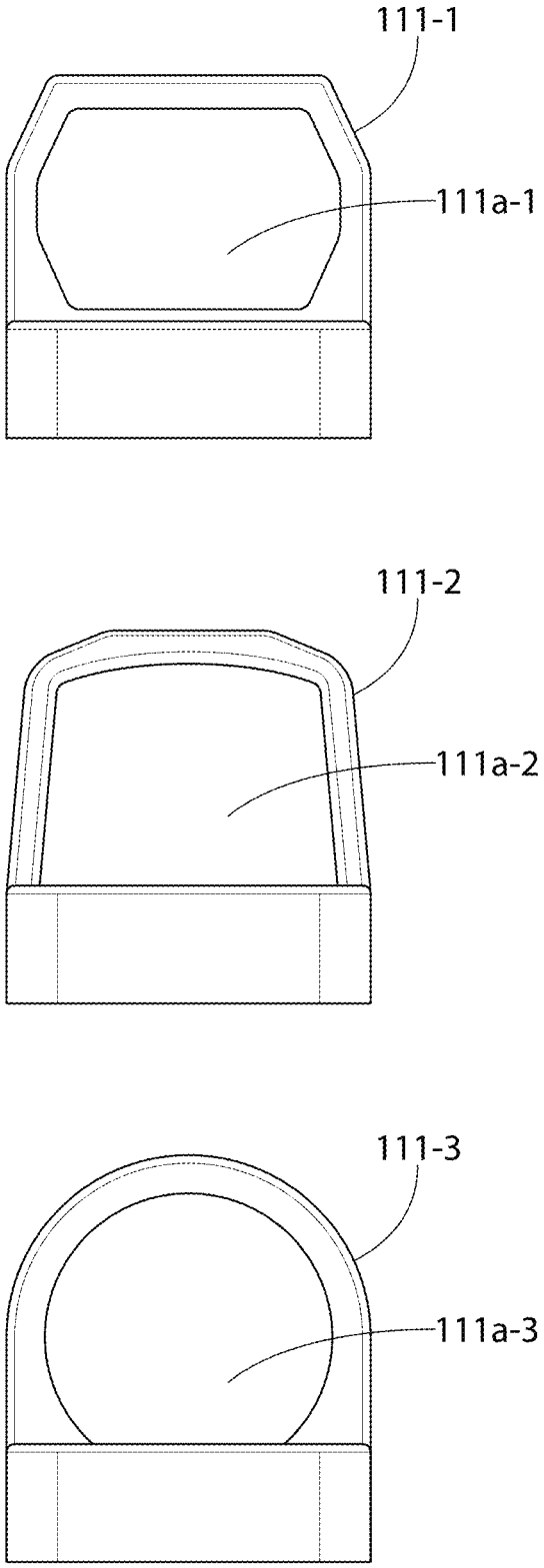
FIG. 15 shows various optional configurations of the lens support frame of the sight housing.
Figure 16:
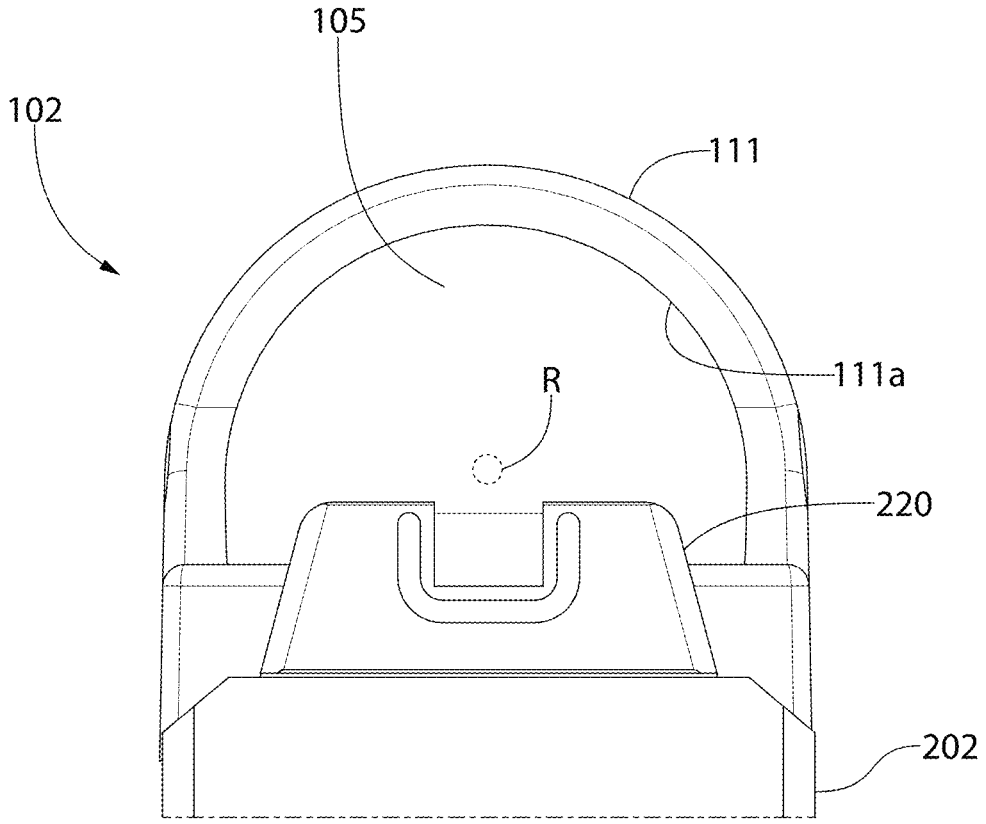
FIG. 16 is a rear view looking forward from the perspective of a user showing the naturally illuminated optical reflex sight with a dot reticle generated on the lens by the fiber optic element.
Figure 17:
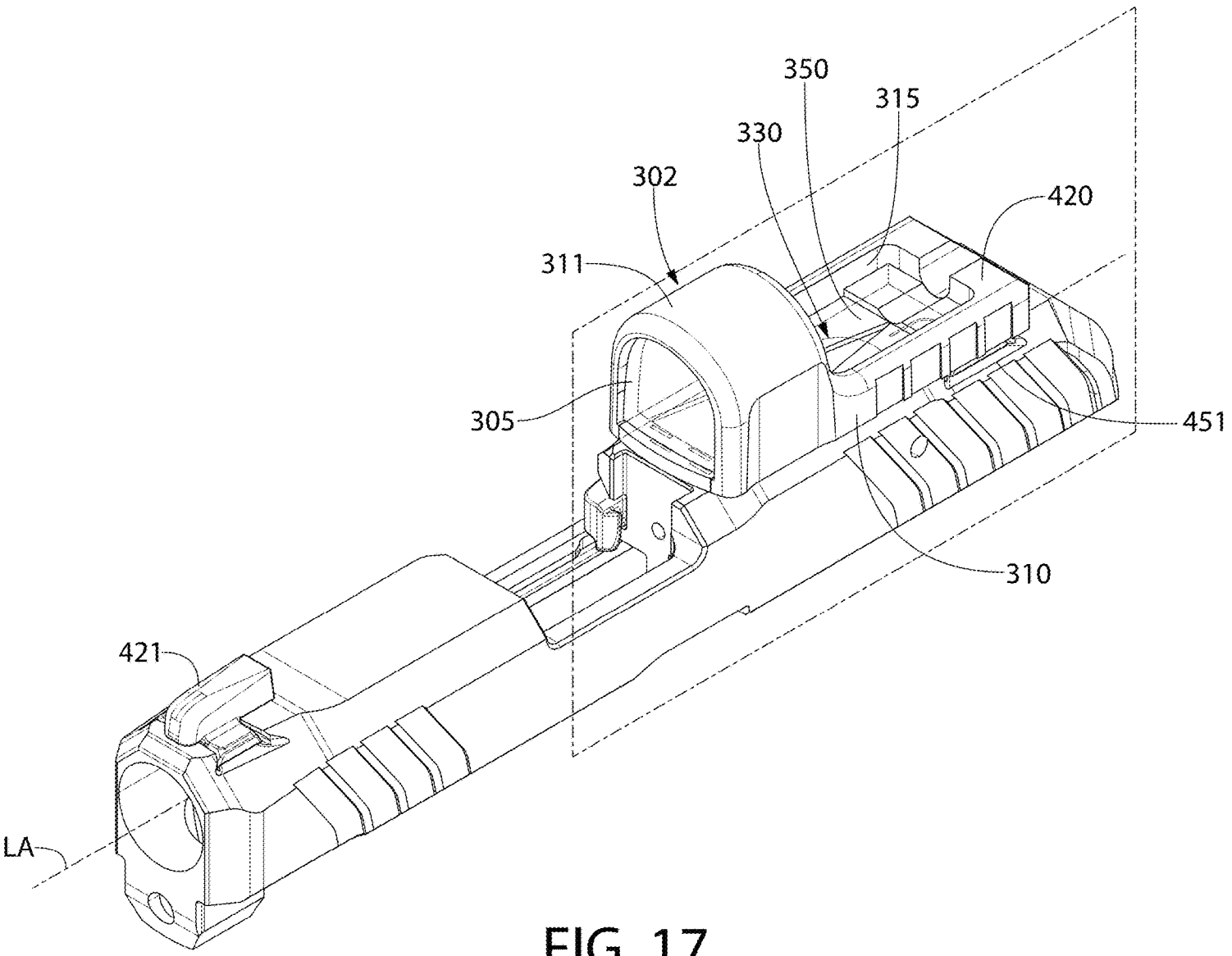
FIG. 17 is a first top perspective view of a second embodiment of a body portion of a firearm including a second embodiment of a naturally illuminated compact optical reflex sight according to the present disclosure.
Figure 18:
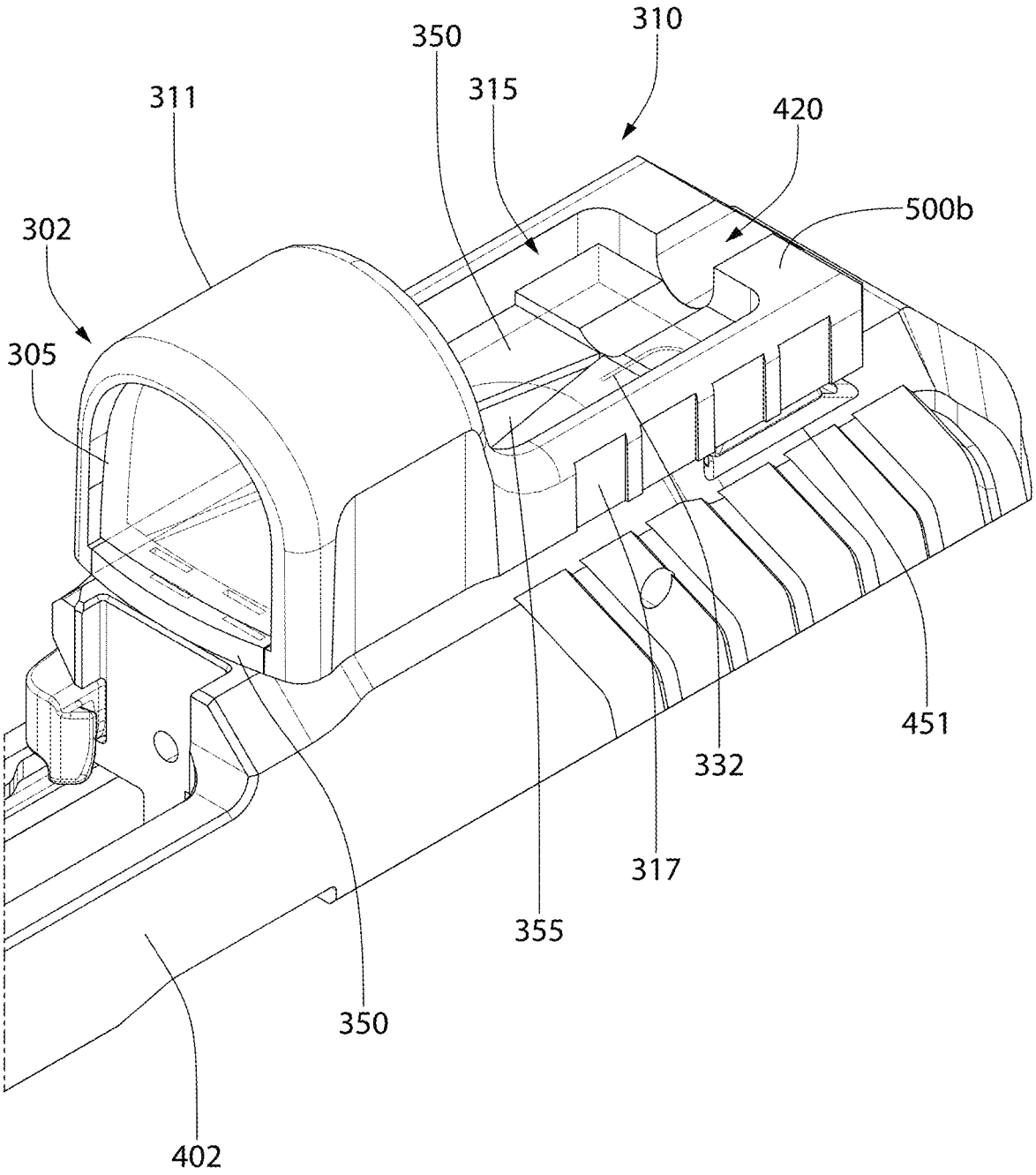
FIG. 18 is an enlarged detail taken from FIG. 17.
Figure 19:
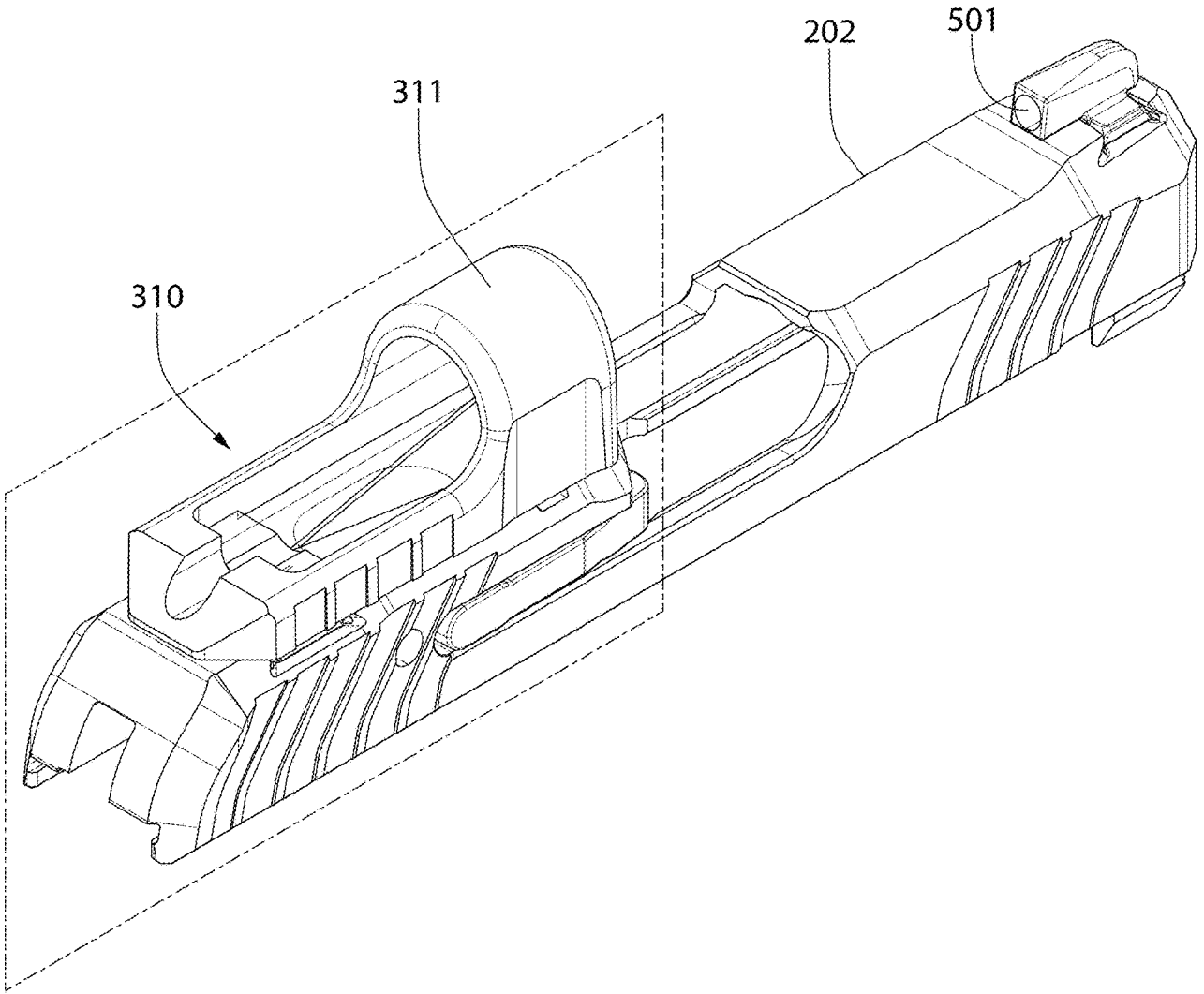
FIG. 19 is second top perspective view of the firearm and sight of FIG. 17.
Figure 20:
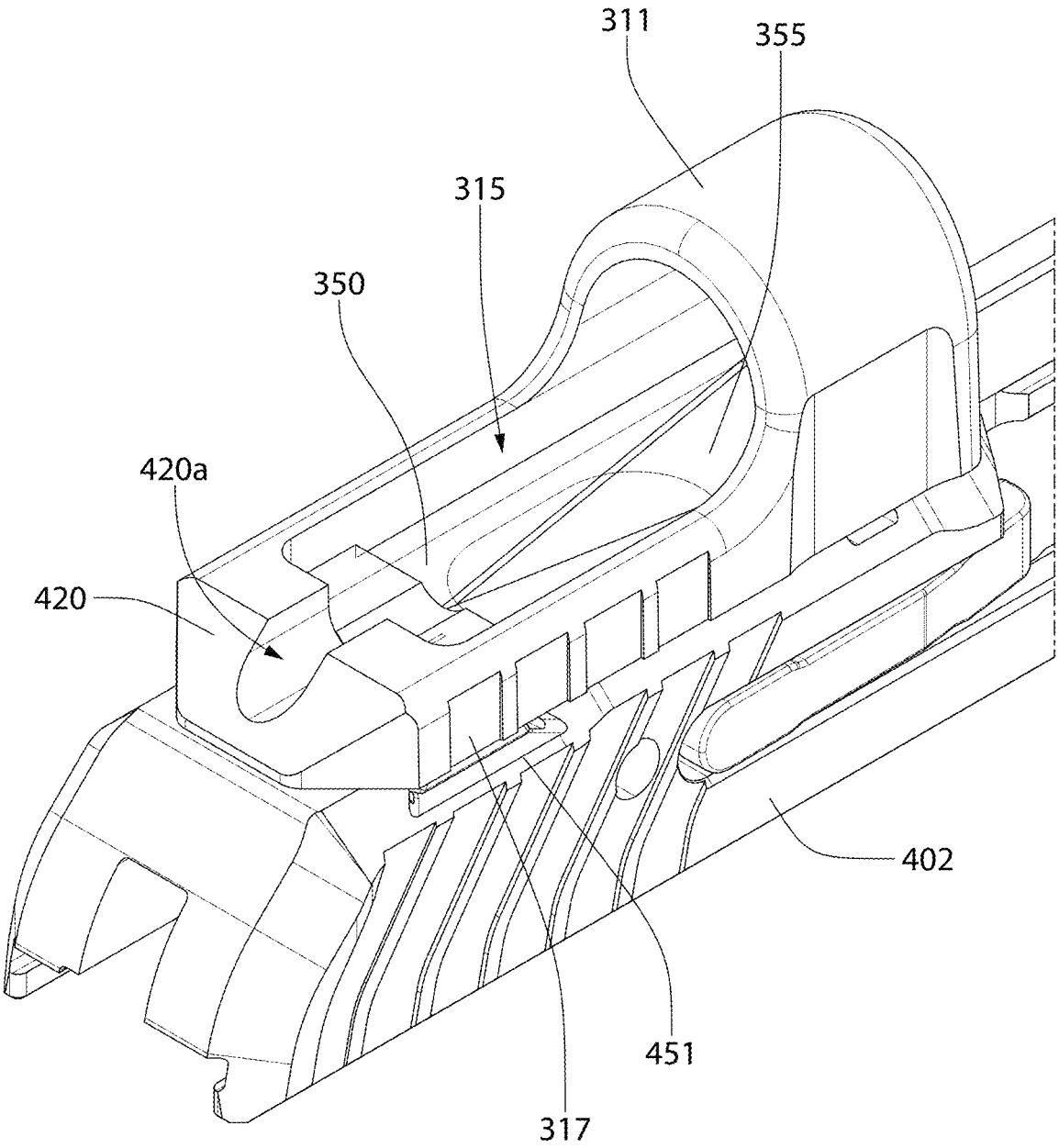
FIG. 20 is an enlarged detail taken from FIG. 19.
Figure 21:
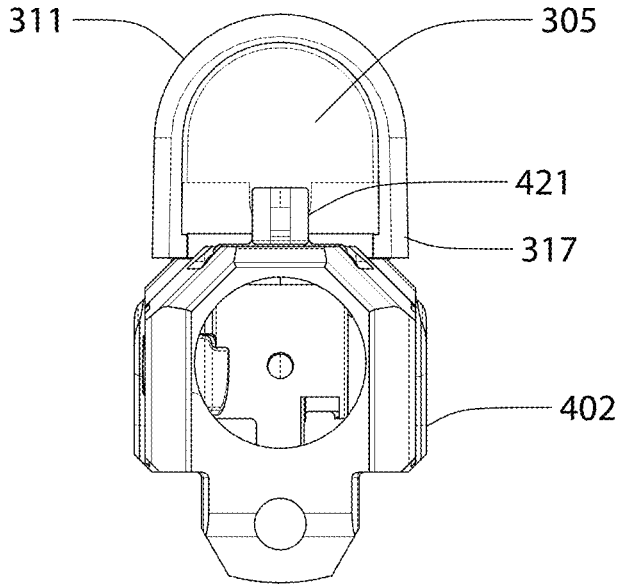
FIG. 21 is front view of the firearm and sight of FIG. 17.
Figure 22:
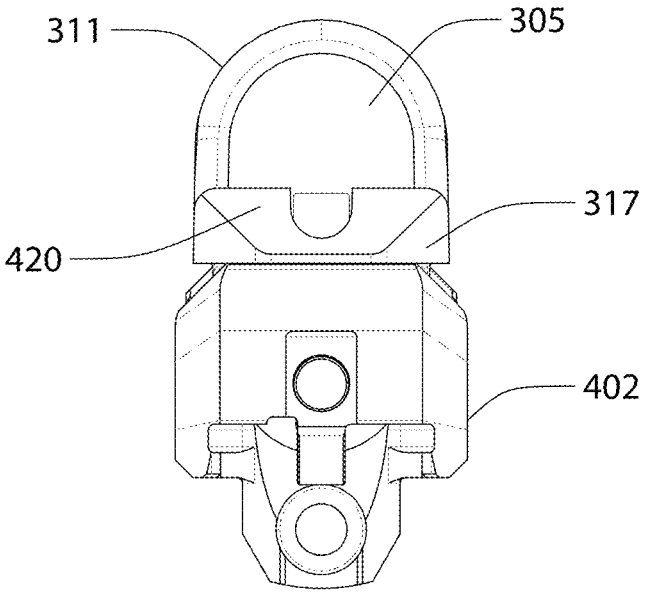
FIG. 22 is a rear view thereof.
Figure 23:
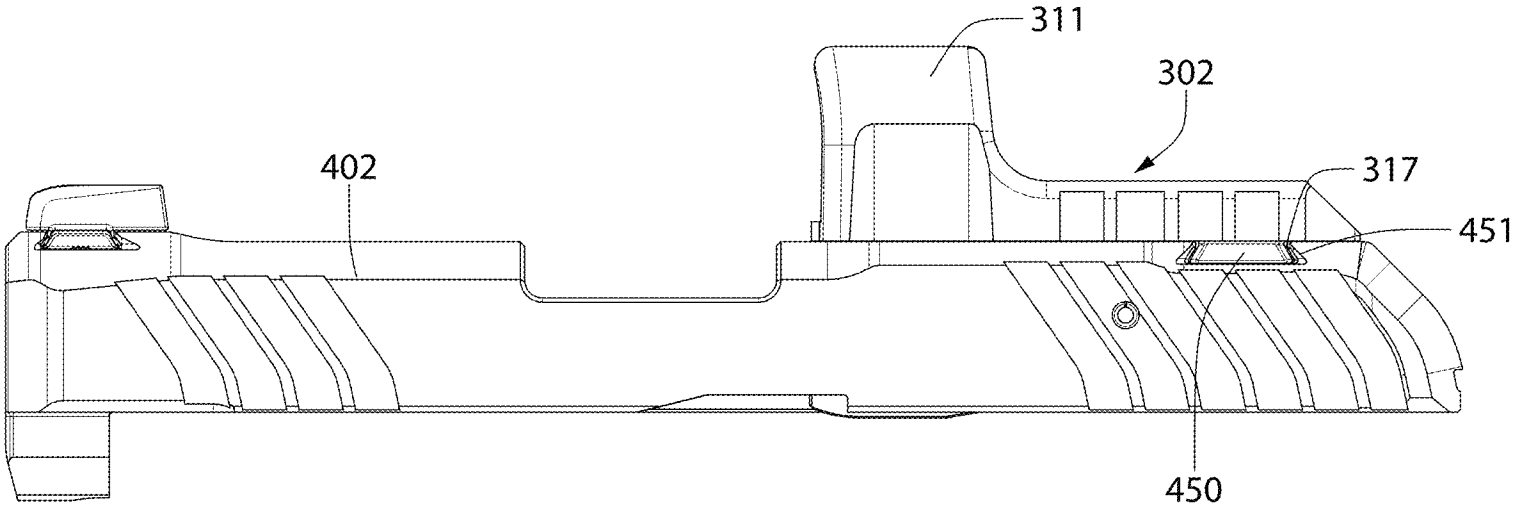
FIG. 23 is a left lateral side view thereof.
Figure 24:
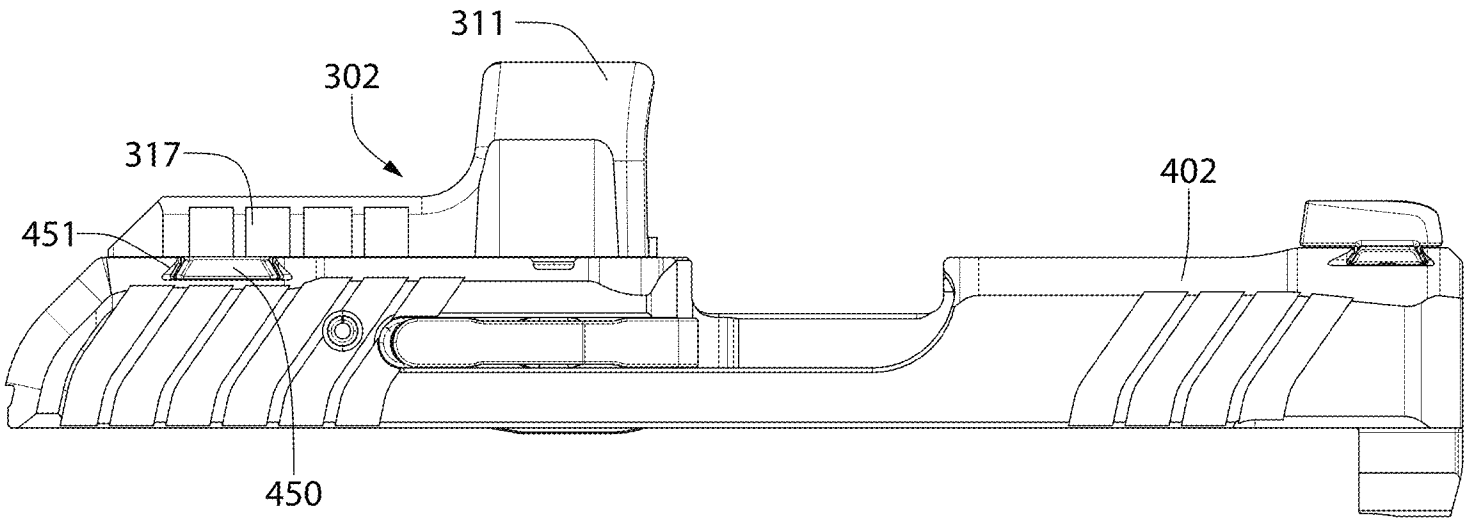
FIG. 24 is a right lateral side view thereof.
Figure 25:
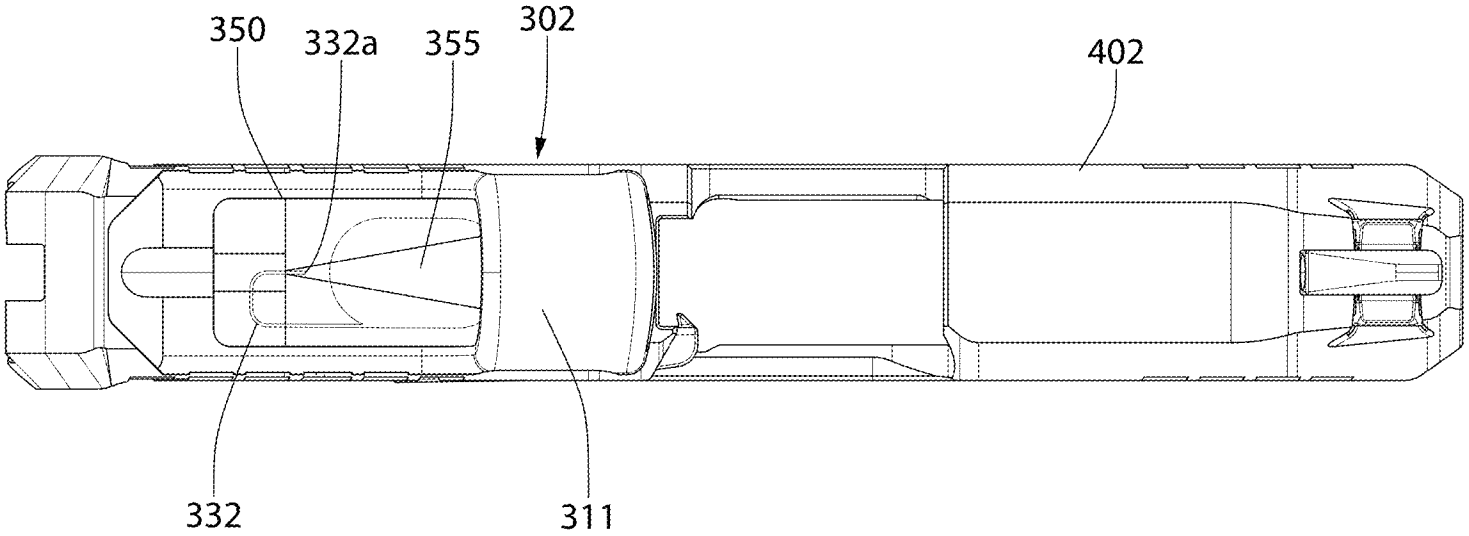
FIG. 25 is a top view thereof.
Figure 26:
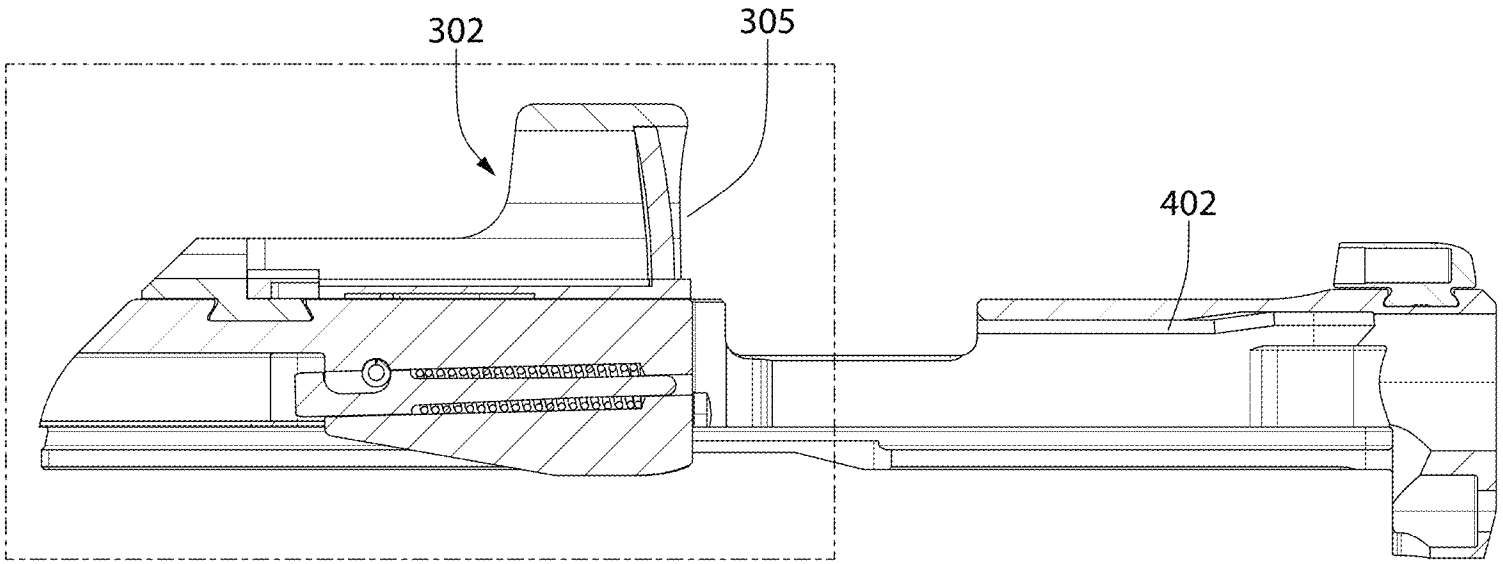
FIG. 26 is a side cross sectional view thereof.
Figure 27:
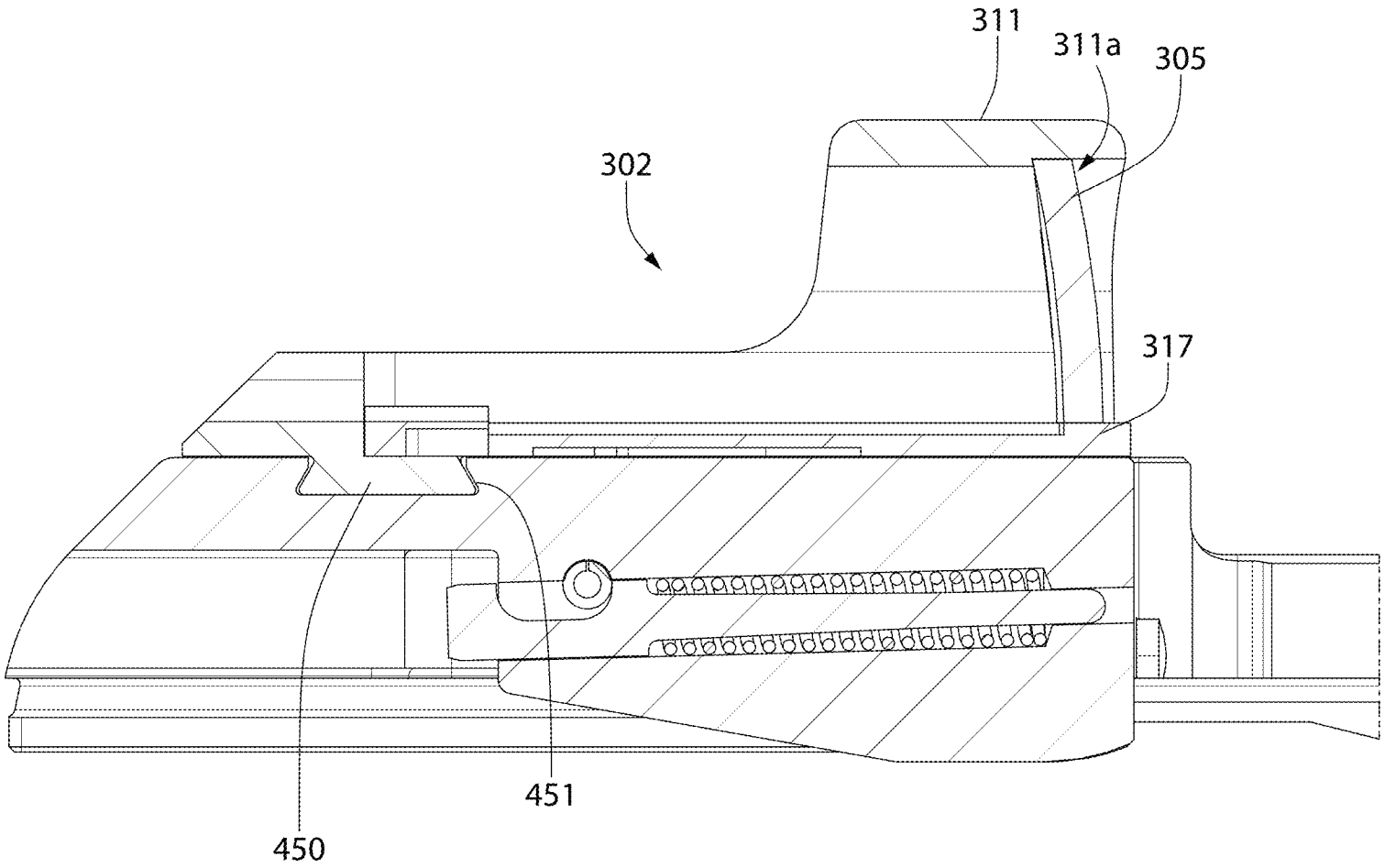
FIG. 27 is an enlarged detail taken from FIG. 26.
Figure 28:
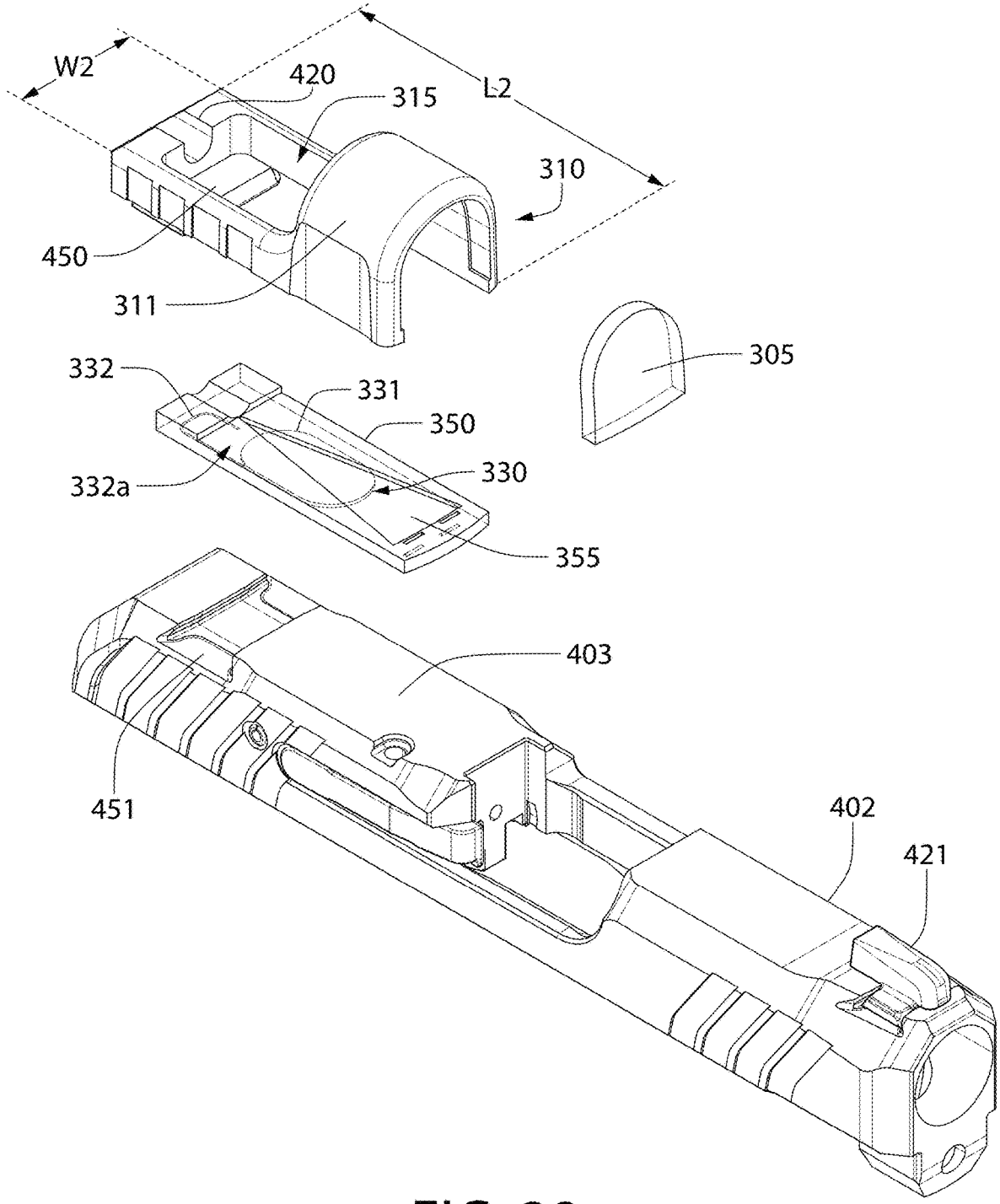
FIG. 28 is a top exploded perspective view thereof.
Figure 29:
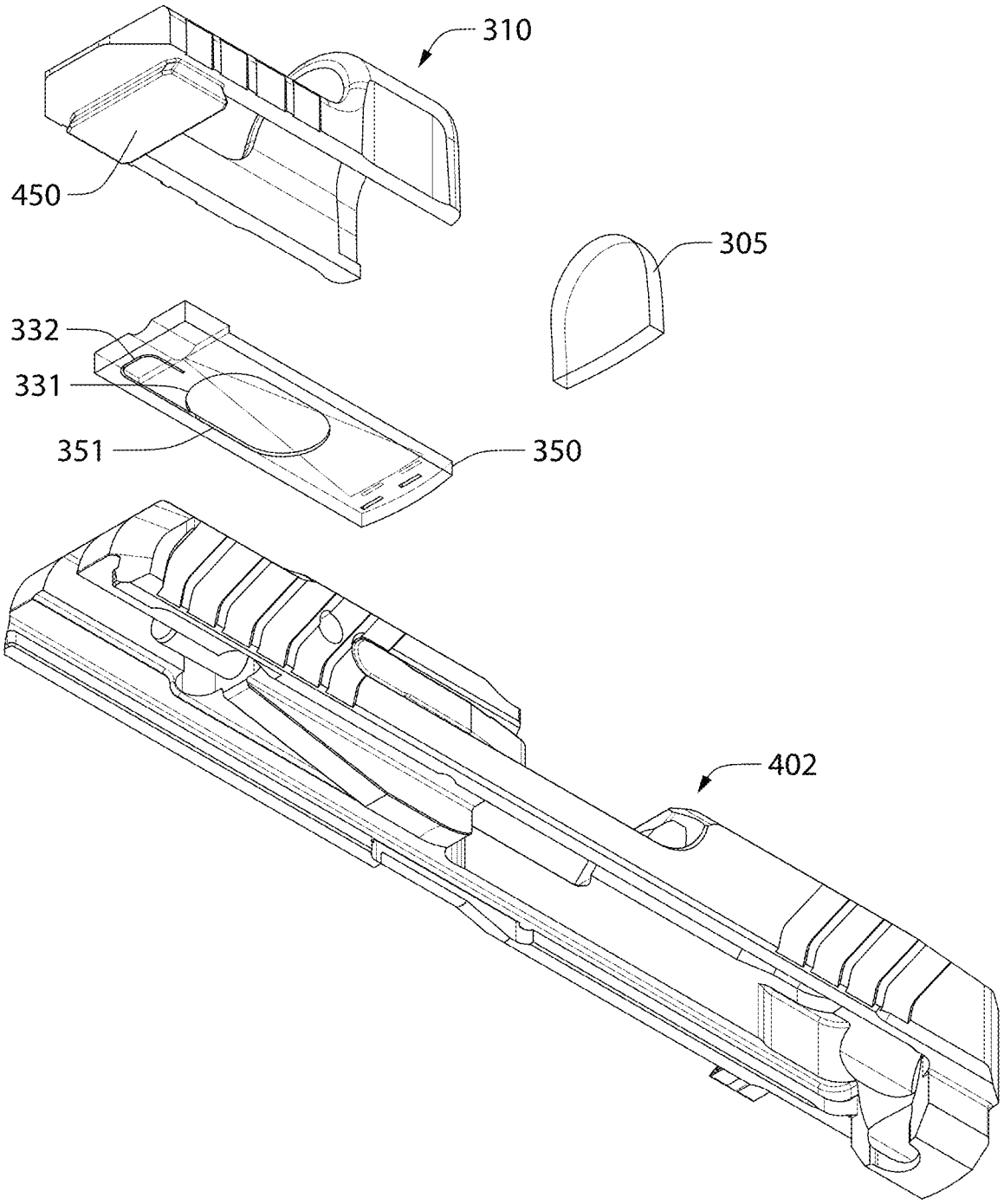
FIG. 29 is a bottom exploded perspective view thereof.

Lens frame portion 111 may be generally arch-shaped and surrounds and protects the lens 105. The lens frame portion 111 defines a central opening 111*a* which receives the lens and accordingly may be complementary configured in shape to match the perimetric shape of the lens. The lens frame portion 111 may be an integral unitary part of the monolithic body of the housing in some embodiments; however, other embodiments may utilize a separately formed frame portion which is permanently or detachably coupled to the base portion. FIG. 15 show some additional non-limiting examples of the shape that the arched lens frame portion 111 may take including arcuately curved configurations and angled or faceted configurations. Lens frame portion 111-1 has an angular configuration including a flat top and angled lateral facets on each side forming a substantially octagon-shaped central opening 111*a*-1. Lens frame portion 111-2 is somewhat similar thereto but has a shorter flat top and more smoothly contoured angled lateral facet forming a substantially (albeit not perfectly) rectangular shaped central opening 111*a*-2. Lens frame portion 111-3 is similar to lens frame portion 111 previously described herein (see, e.g., FIG. 16) but has a central opening 111*a*-3 which forms more of a complete circle by comparison. Numerous other shaped lens support portions of housing 110 may be used of course. Accordingly, the shape of the lens frame portion 111 of the housing does not limit the invention in any respect.

Notably, the housing 110 is specially configured to optimize the amount of natural ambient light which can reach and illuminate the fiber optic element 130 from multiple directions (e.g., at least four different directions in one embodiment-more or less in others). Accordingly, in one embodiment the housing 110 includes a plurality of open light collection and transmission windows 120 arranged and operable to collect and transmit ambient light through the preferably clear/transparent cover 150 to the fiber optic element 130 where the light is absorbed and transmitted to generate the reticle on the lens. In one non-limiting example, the housing may comprise a forward-facing front window 120*a*, a pair of opposing lateral side windows 120*b* (right side) and 120*c* (left side), and a large upwardly open top window 120*d*. All of the windows are in visual/optical communication with light-gathering cavity 115 of housing 110 to illuminate the fiber optic element 130.

The top window 120*d* is located between the front arched lens frame portion 111 of housing 110 and its rear end 113, and formed by the upwardly open light-gathering cavity 115 of the housing. Front window 120*a* is formed by central opening 111*a* of the housing upright lens frame portion 111.

Each lateral window 120*b*, 120*c* is formed by an opening extending completely through and penetrating the pair of right and left sidewalls 121*a*, 121*b* of housing 110. In one embodiment, the lateral windows may have an elongated slot shape to maximize the amount of ambient light collected through the windows.

The foregoing windows 120*a*-120*d* each visually communicate directly with and transmit available ambient light to the light gathering fiber optic element 130 enclosed by the cover 150. Accordingly, the fiber optic element 130 is exposed to ambient light through the windows via the clear cover 150.

The base portion 117 of housing 110 defines the upwardly open cavity 115 configured to receive and mount the cover 150 therein and at least the coiled section of fiber optic element 130. The cover 150 may be detachably and fixedly mounted to the housing within cavity 115 by any suitable means, such as without limitation threaded fasteners, snap fit interlocked features, or other techniques used in the art to detachably coupled two components together. In one non-limiting embodiment, threaded fasteners 118 may be used which pass through corresponding fastener holes 118*a* and 118*b* in the cover 150 and base portion 117 of housing 110 to threadably engage threaded coupling holes 118*c* formed on the sight mounting section 203 of the firearm. The same fasteners 118 therefore efficiently mount the cover and sight housing to the firearm.

The lens 105 may be similar to many other existing reflex sight lenses, which are typically constructed of an optical grade polymer or glass. It can be constructed by stacking multiple lenses together to form a single optical element and may be rearwardly concave slightly in some embodiments (see, e.g., FIG. 9). The lens 105 may include reflective and anti-reflective coatings applied to filter certain wavelengths of light and maximize brightness of the reflection of the illuminated dot reticle generated by the fiber optic element on the surface of the lens. The shape of the lens 105 is designed such that the reflection of the illuminated reticle forms a virtual image which appears to be several meters or more in front of the firearm to the user.

In one non-limiting embodiment, the illumination element of the present naturally illuminated sighting system is formed by fiber optic element 130 which may be constructed from a highly flexible extruded fiber optic rod of polymeric light-transmission material. Light (ambient and/or from external lighting not onboard the firearm or sight housing including artificial overhead lighting fixtures, etc.) enters the fiber optic element and bounces off internal reflective surfaces within the element. The exposed ends of the rod allow the reflected light to escape. The net effect is that the ends emit light at a higher intensity due to the gathering of internal reflections within the fiber optic element. This light has a high enough intensity to produce a reflection upon a lens surface that can create a reticle for the shooter. By utilizing a small diameter rod (e.g., about 0.010 inch in one non-limiting embodiment), the reticle is formed directly by the fiber optic element without an aperture component.

In the non-limiting illustrated embodiment, the fiber optic element 130 includes a single strand and curved light-emitting end portion or section 132 at rear, and a contiguously formed light-absorbing circuitous section which in one embodiment may be formed by coiled section 131 at front. Coiled section 131 may have a multiple loop construction and configuration comprised of two or more concentrically arranged and aligned loops of the optical rod. It bears noting that sections 131 and 132 may be formed by different portions of a single flexible fiber optic rod manipulated to produce the shape shown and described herein. The light-emitting end section 132 defines the free terminal end 132*a* which emits and projects the captured ambient light that produces the dot reticle on the lens 105.

As previously noted, the coiled section 131 advantageously increases the available surface area of the fiber optic element and concomitantly the amount of ambient light which can be absorbed in the available small footprint or space within the housing of the sighting system. The coiled section 131 may be located forward of the light-emitting end section 132 of the fiber optic element as shown in the illustrated embodiment. The end section 132 may have a recurvant shape in one embodiment as shown in the figures which bends around itself 90 degrees forming a hook-like shape. The light-emitting terminal end 132*a* of fiber optic element 130 is spaced rearwardly from lens 105 by a specific distance to project a focused reticle R on the lens. Terminal end 132*a* and the adjacent end section 132 of the fiber optic element are also angled upwards obliquely to sight axis SA of the ambient light illuminated reflex sight 102 towards a central portion of lens 105 to project the illuminated reticle thereon.

It bears noting that in other embodiments, the coiled section 131 of fiber optic element 130 may be at the rear and light-emitting end section 132 may be in front and not recurvant in shape.

The current illustrated embodiment of the fiber optic element 130 may use a single monofilament fiber optic rod to form the light-emitting end section 132 and adjoining light-absorbing coiled section 131 which may include an oval or circular coil comprised of multiple loops formed from the fiber optic rod. The loops or coils of the coiled section may be concentrically arranged and adjacent in relation to each other in a closely packed loop to maximize the amount of natural ambient light absorbed. The fiber optic element 130 may therefore have a greater thickness in the light-absorbing coiled section 131 than the single strand light-emitting end section 132.

An oval loop design may be used in one embodiment for the light-absorbing coiled section 131. In other embodiments, a circular loop design may be used. In yet other embodiments contemplated, other arrangements and configurations of the fiber optic rod may be used which result in a high density pattern (e.g., zig-zag rows of the fiber optic rod side-to-side or front-to-rear, parallel rows side-to-side or front-to-rear, etc.). One design goal is to use a fiber optic rod having a total unwound length sufficient to absorb an amount of ambient light sufficient to produce a clearly visible reticle on the lens at all times under varying ambient lighting conditions dawn to dusk. The reticle R is formed by light transmitted onto the lens from the light-emitting terminal end 132*a* of the fiber optic element 130.

In other possible implementations, the fiber optic element could alternatively be a custom molded polymer component with a design including internal optical surfaces designed to reflect gathered light and maximize the light output and intensity from the exposed end of the fiber optic element aimed at the lens 105.

The cover 150 of the optical reflex sight 102 may be preferably made of a light-transmissible material such as transparent/clear polymer as one non-limiting example. The cover may be a generally rectangular cuboid shaped block of solid material in one embodiment configured to fully cover and encase the fiber optic element 130 for protection while concomitantly allowing light to pass through and enter the element. A downwardly open recess 151 on the bottom of cover 150 configured to receive and enclose at least the coiled portion or section 131 (e.g., concentric loops) of the fiber optic element may be provided as shown in one embodiment. The fiber optic element 130 may be mounted directly to and fully supported by the cover independently of the sight housing. Accordingly, the coiled section 131 in some embodiments may be secured directly to the cover inside the recess 151 by a suitable method including without limitation adhesives or "potting" with a suitable hardenable electronic component potting material.

In one embodiment, the clear fiber optic element cover 150 may further comprise a rear fiber support extension 152 which defines a guide channel 153 which receives, guides, and supports the single strand and recurvant light-emitting end section 132 of fiber optic element 130. Fiber support extension 152 projects rearwardly from the rectangular front main portion 154 of the cover which holds the coiled section 131 of the fiber optic element 130. Fiber support extension 152 may have any suitable shape for its purpose. In certain embodiments, fiber support extension 152 may have a lateral width less than the front main portion 154 as shown.

Guide channel 153 communicates with bottom recess 151 of the cover for threading the single strand light-emitting end section therethrough. On the top rear of cover 150, the channel terminates with a forward illumination opening 153*a* which receives and exposes the light-emitting terminal end 132*a* of the fiber optic element 130 for projecting the reticle on the lens 105. The optical element terminal end 132*a* of recurvant single strand end section 132 of optical fiber element 130 may be completely nested within forward illumination opening 153*a* of cover 150 for protection from damage when handling the sight or firearm.

In certain embodiment, the top surface of cover 150 may include a downwardly and rearwardly sloping illumination ramp 155 extending rearwards from a central part of the front main portion 154 of cover 150 to the illumination opening 153*a* at the rear of the cover. This prevents physical and visual obstruction of the reticle light beam projected forward through the air onto the lens 105 by fiber optic element 130 (see, e.g., FIG. 9 dashed reticle light beam lines and resultant reticle R produced on the lens). In other designs, the ramp may be omitted depending on the configuration of the cover 150 provided if no illumination path obstruction occurs. The reticle light beam follows a light path that is obliquely angled to sight axis SA and longitudinal axis LA of the firearm.

Figure 10:
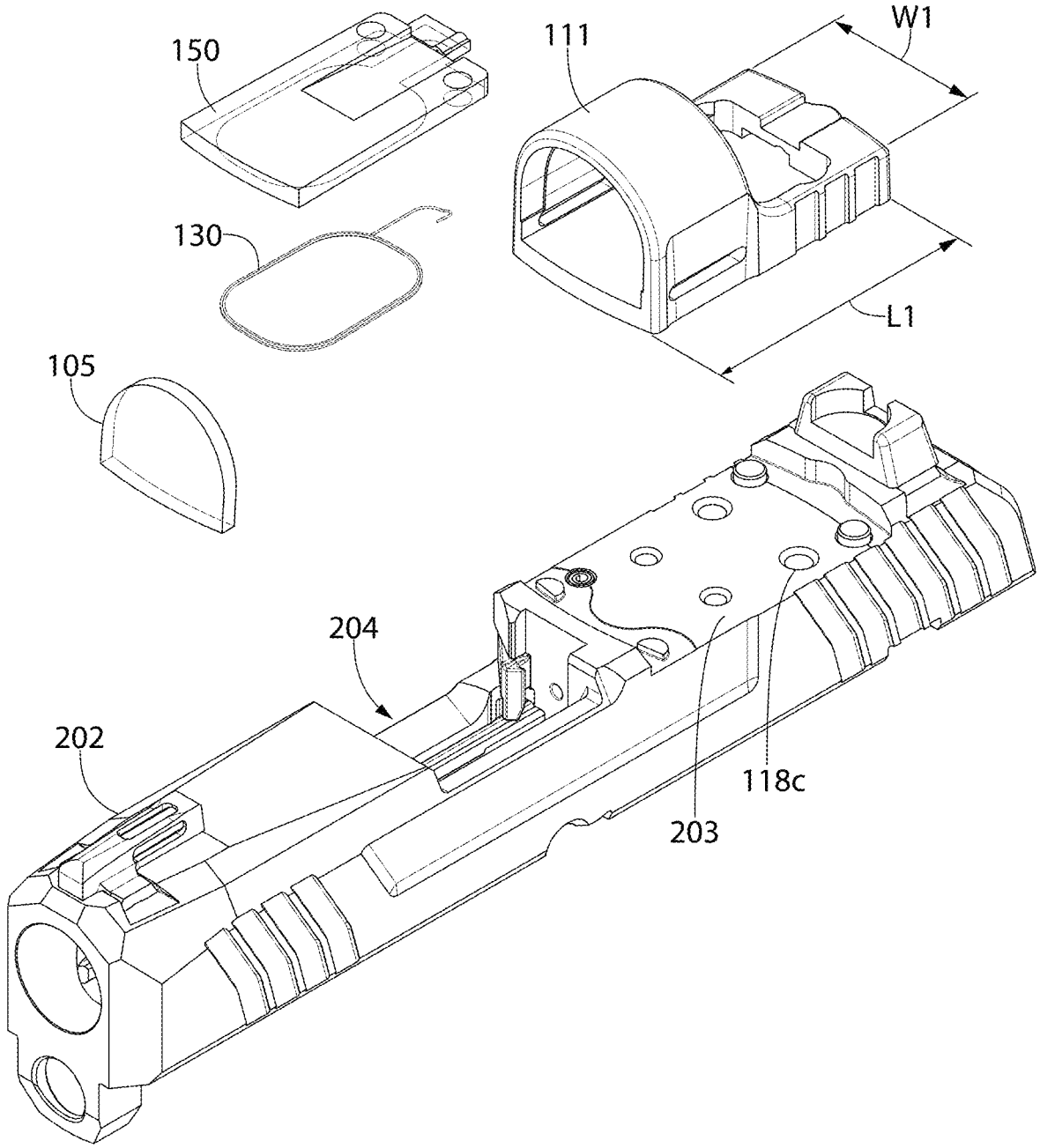
FIG. 10 is an exploded top perspective view of the firearm and sight of FIG. 1.
Figure 10A:
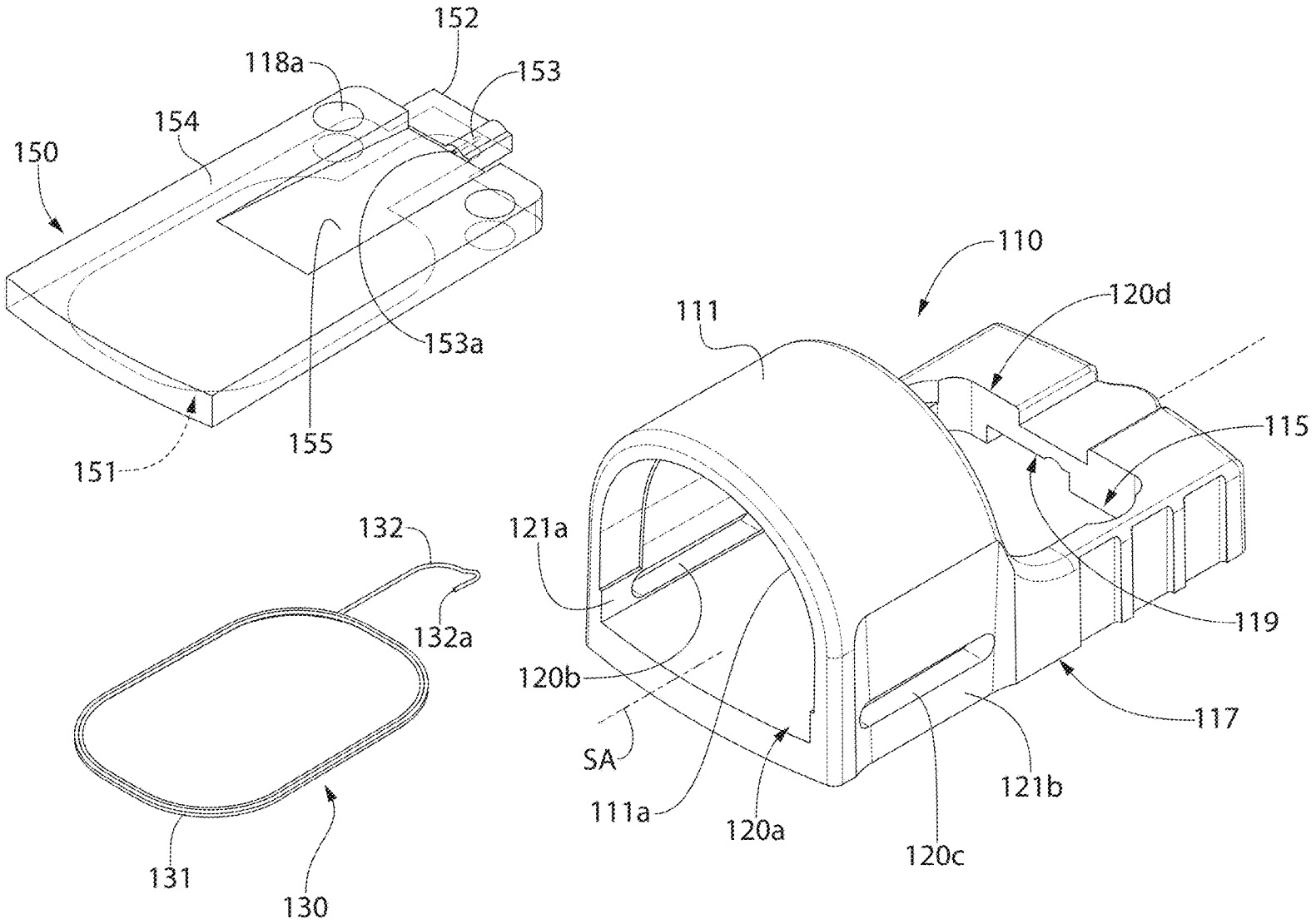
FIG. 10A is an enlarged view of the sight components shown in FIG. 10.
Figure 11:
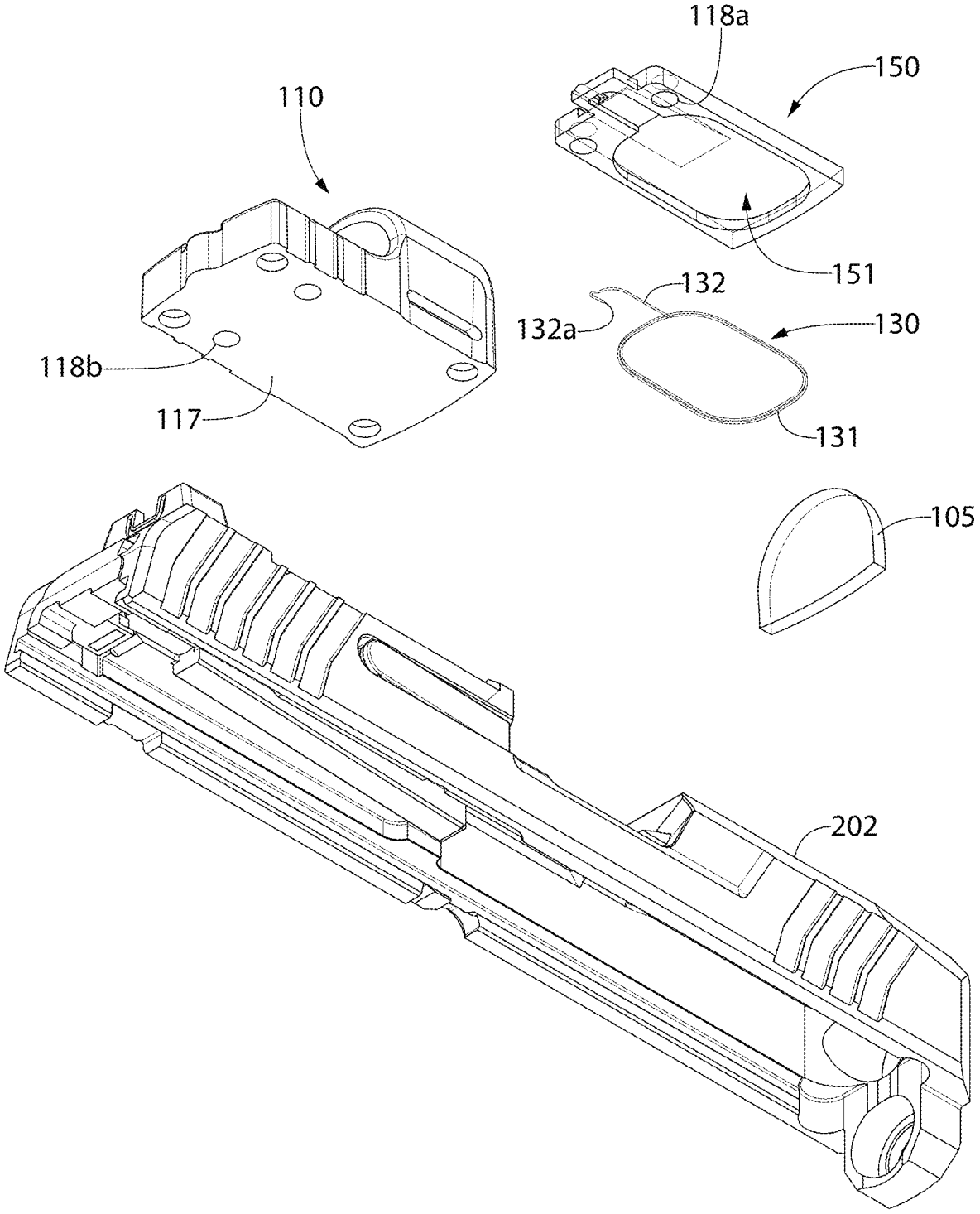
FIG. 11 is an exploded bottom perspective view of the firearm and sight of FIG. 1.
Figure 12:
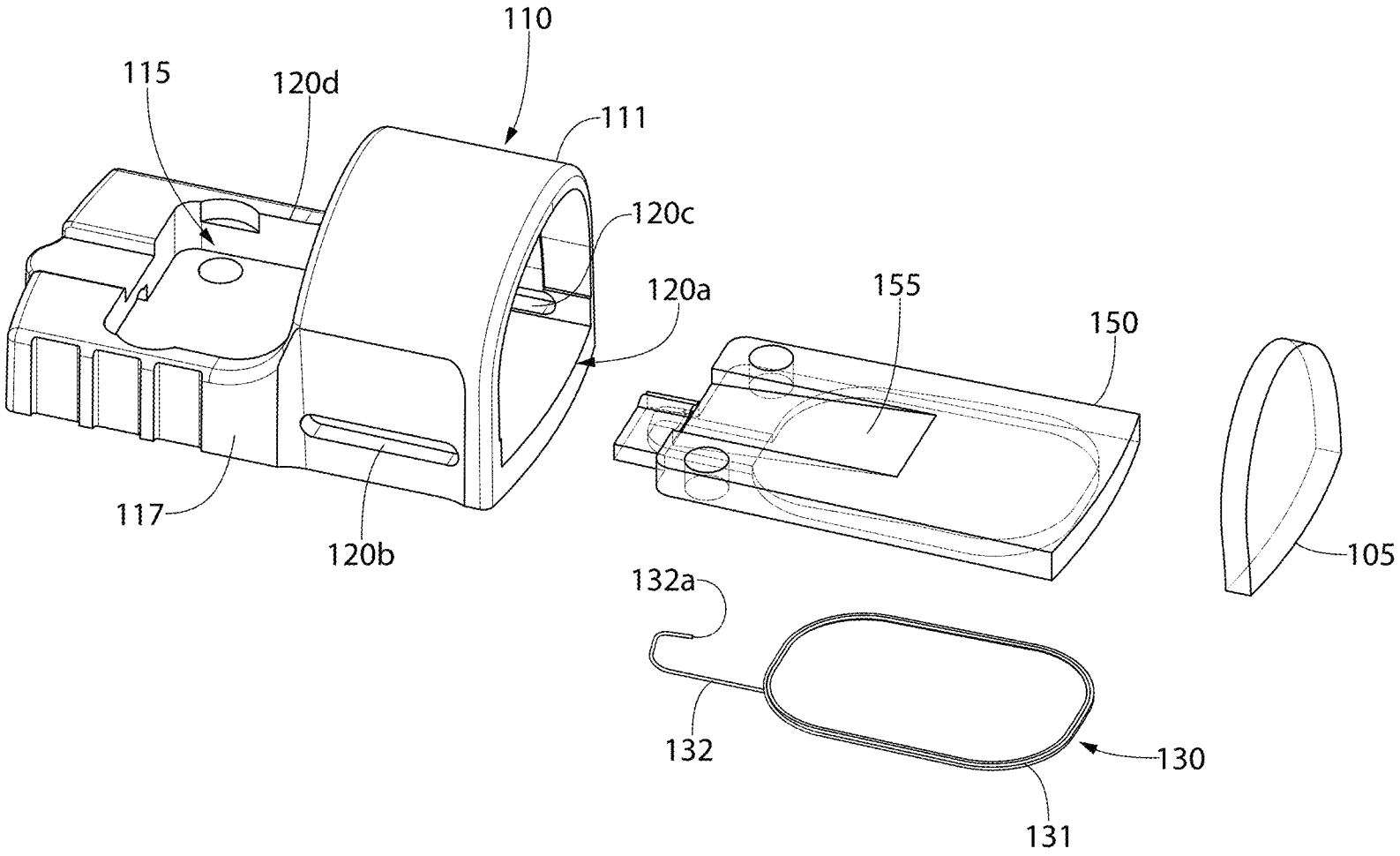
FIG. 12 is an exploded perspective view of the sight components alone.
Figure 13:
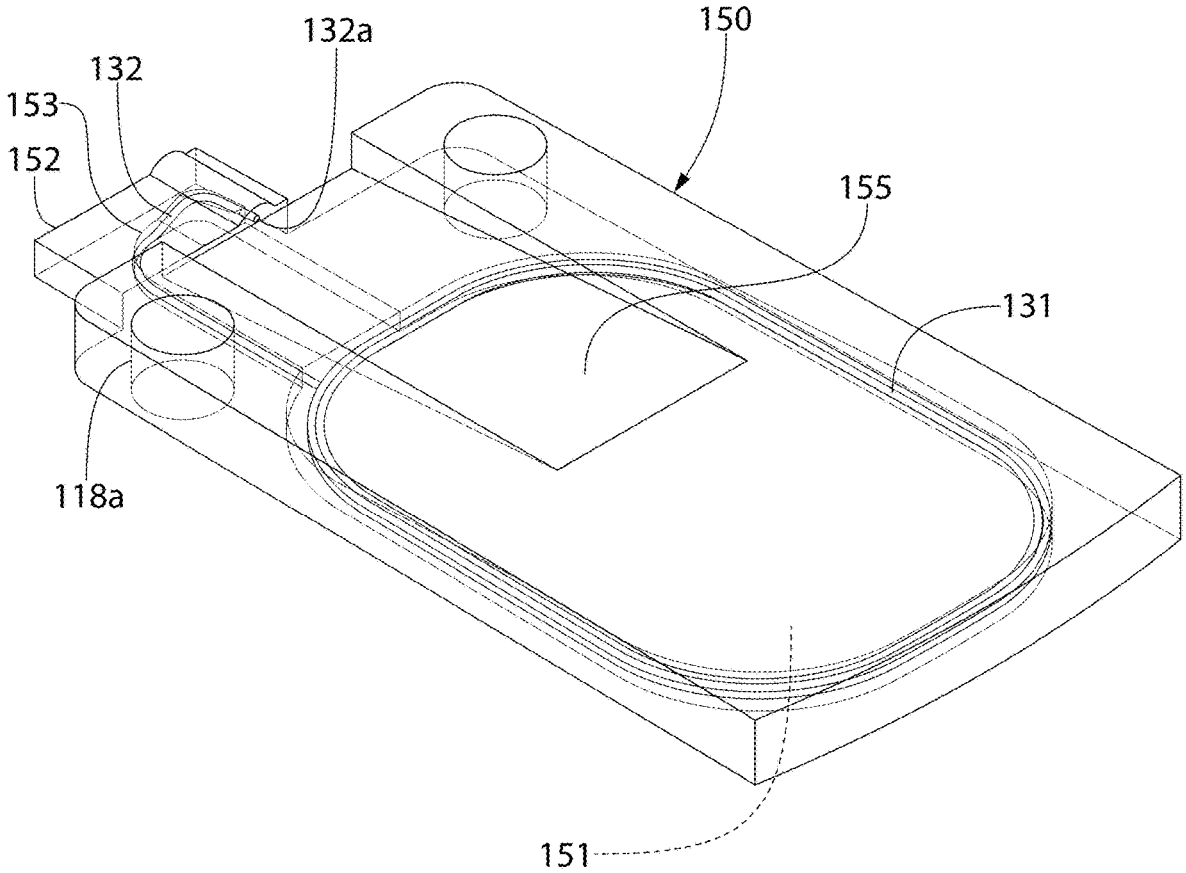
FIG. 13 is a top perspective view of the fiber optic element protective cover of the sight.
Figure 14:
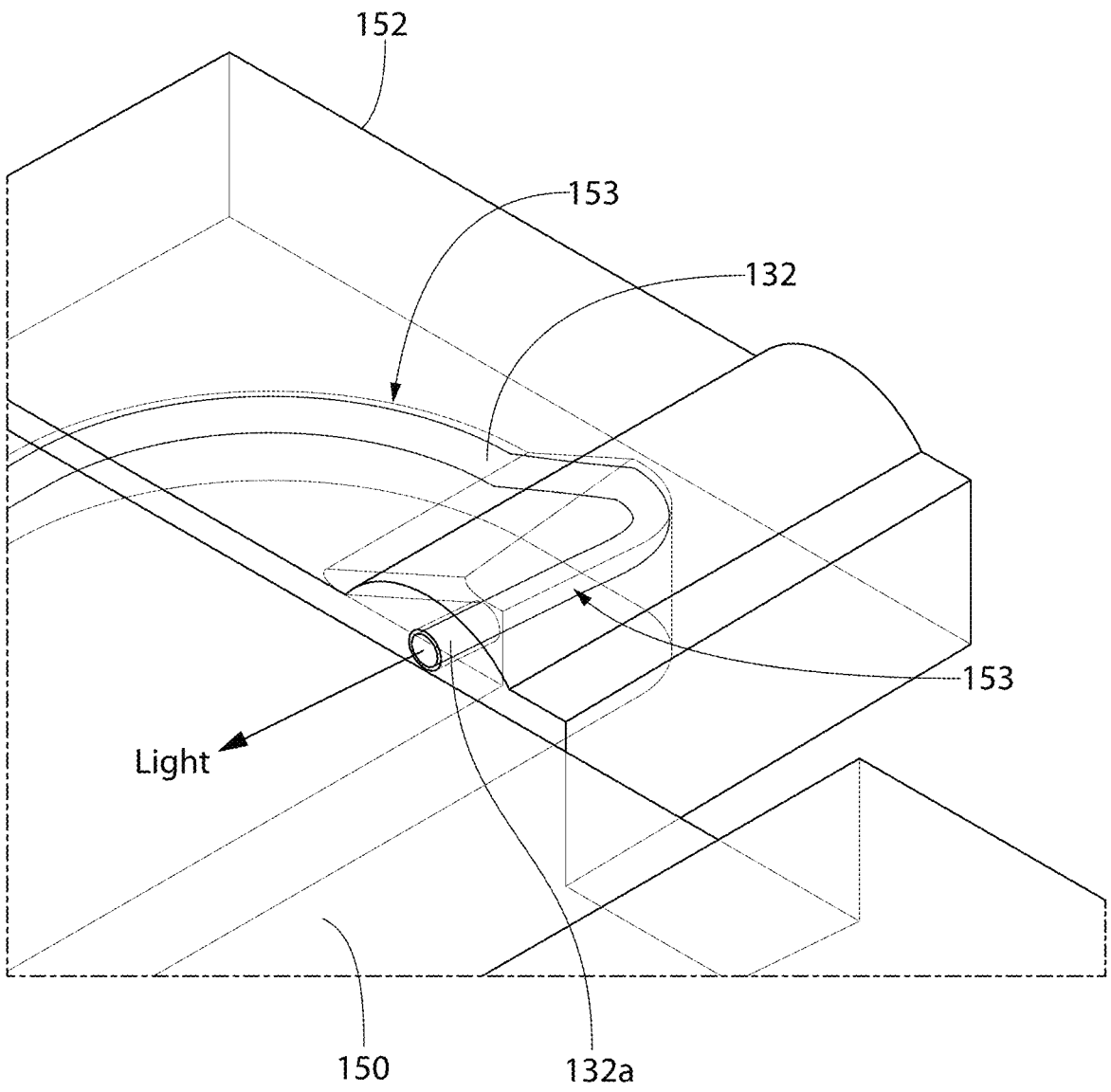
FIG. 14 is an enlarged perspective view of a rear extension of the protective cover.

To further protect the exposed terminal end 132 of fiber optic element 130, the sight housing 110 in some embodiments may include a downwardly and forwardly open receptacle 119 at the rear end 113 into which the fiber support extension 152 of cover 150 may be slideably received and inserted. The receptacle 119 may be formed in base portion 117 of housing 110 and be complementary configured to the fiber support extension 152 such that the extension is nested therein (see, e.g., FIG. 10A). When the fiber support extension 152 is inserted in receptacle 119, only the front main portion 154 of the cover remains visible to collect and transmit ambient light to fiber optic element 130

To assemble and mount the light-transmissible cover 150 in the housing 110, the cover may be slideably inserted rearwards into cavity 115 of the housing through the open front end 112 of the housing formed by the central opening 111*a* of arched lens frame portion 111. The fiber support extension 152 is slideably inserted rearwardly into the receptacle 119 at the rear of cavity 115 in the housing 110. Once the cover is in place, the threaded fasteners 118 may be inserted through the cover and base portion 117 of the housing to secure the cover. To remove the cover, the foregoing assembly process is reversed. In one embodiment, the cover 110 cannot be removed upwardly from the housing cavity 115.

As shown, the front end of the cover 150 is located adjacent to central opening 111*a* of the arched lens frame portion 111 of housing 115. As previously described herein, central opening 111*a* defines the front window 120*a* in the housing for collecting and transmitting ambient light to the coiled section 131 of fiber optic element 130. When the cover is fully mounted in housing 110, the front end of the cover is disposed adjacent to the bottom end of the lens 105.

The firearm 200 may also include a front iron sight 221 and rear iron sight 220 fixedly mounted to slide 202. Rear iron sight 220 may be mounted to the firearm just to the rear of and proximate to the dot reticle optical reflex sight 102. In preferred but non-limiting embodiments, the rear iron sight and front iron sight are provided in conjunction with the ambient-lighted optical reflex sight 102 for aiming when available natural light may be insufficient to produce a reticle R of adequate intensity. The optical reflex sight 102 may be configured such that the front iron sight is visible through lens 105 during such times with the rear iron sight for aiming.

When assembled into the housing 110, the light-transmissible cover 150 is designed so that light may enter from the top, left, right and front of the housing assembly via the light collection and transmission windows 120*a*, 120*b*, 120*c*, and 120*d* of the housing as previously described herein. This offers an advantage over other fiber illuminated reflex sights, which do not maximize light collection angles from multiple sides and include a battery-operated artificial source of light mounted in the housing. It bears noting that the present naturally illuminated dot reticle optical reflex sight 102 continuously produces a reticle on lens 105 so long as there is a sufficient level of ambient light available. There is no "on" or "off" switch.

The optical reflex sight 102 advantageously may provide maximum light output for the reticle with few or no moving parts or features necessary or desired for making any adjustments. Other possible embodiments depending in part on the firearm however may include provisions which include a sight adjustment mechanism, a battery-powered LED to illuminate and increase light output from the fiber optic element such as when lower ambient light levels are encountered, and/or a versatile firearm mounting interface configured for mounting the sight on various different weapons platforms and types. Accordingly, numerous supplemental features and variants of the naturally and passively illuminated sight may be provided.

In some embodiments, the present fiber optic reflex sight may be configured to provide a micro pistol sized natural ambient light illuminated reticle fiber optic sight such as for a small format concealed carry semi-automatic pistol 400. FIGS. 17-29 show such a compact firearm and a corresponding second embodiment of a compact dot reticle optical reflex sight 302. Sight 302 contains essentially all of the features and is the same as dot reticle optical reflex sight 102 previously described herein including operation of the sight via natural ambient light collection and transmission to illuminate fiber optic element 330. Those similar features of the sight will not be repeated here for sake of brevity and are assigned "300" series feature designation numbers instead. The smaller compact pistol and its components including the slide on which compact sight 302 is mounted have been assigned "400" series feature designation numbers. Some of the differences necessary for adaptation of the reflex sight to smaller concealed carry pistols and some common features will be described below.

Referring to FIGS. 17-29, optical reflex sight 302 includes a compact housing 310 comprising base portion 317 defining upwardly open cavity 315 which receives light-transmissible cover 350 that houses fiber optic element 330 therein, and arched lens frame portion 311 supporting lens 305. Frame portion 311 may be integrally formed as a monolithic unitary structural part of housing 310 with the base portion. The compact sight 302 further includes lens 305 and light-transmissible cover 350 which supports fiber optic element 330 in its downwardly open recess 351. Cover 350 may include downwardly and rearwardly sloping illumination ramp 355 similarly to cover 150 and for the same purpose to prevent obstruction of the light beam emitted from light-emitting terminal end 332*a* of the fiber optic element end section 332 which emits and projects the captured ambient light that produces the dot reticle on the lens 305. Fiber optic element 330 includes light-absorbing circuitous section such as coiled section 331 similarly to fiber optic element 130 previously described herein.

The compact sight 302 may be mounted to the smaller size and profile slide 402 of a pistol in one embodiment via any suitable method such as the same manner previously described herein that sight 102 is mounted to the larger size and profile slide 202 at the sight mounting interface (e.g., fasteners). In the non-limiting illustrated embodiment, however, housing 310 of sight 302 may instead be detachably coupled and mounted to the rear portion of the firearm slide 402 via a mating dovetail and complementary configured slot arrangement (see, e.g., FIGS. 17-18 and 28-29). Housing 310 comprises a downwardly projecting male dovetail protrusion 450 which is slideably received in a mating female dovetail slot 451 formed in the top surface of the rear end portion of the slide. The dovetail protrusion may be integrally formed with the body of housing 310 as a unitary structural part thereof in some implementations. Dovetail protrusion 450 is laterally inserted in a direction (i.e. transverse to longitudinal axis LA and sight axis SA) into the dovetail slot 451 to secure the fiber optic reflex sight 302 in place on the firearm slide 402. In some embodiments, a small set screw (not shown but known in the art) may be used to lock the sight 302 in place within the dovetail slot.

The compact concealed carry pistol slide 402 includes a front sight 421. Because the slide 402 is smaller, the compact housing 310 of sight 302 includes an integral rear iron sight 420 formed as a unitary structural part of the housing. By contrast, rear iron sight 220 of the larger size slide 202 may be mounted directly to the rear end of the slide due to the greater amount of available space on the larger slide.

For the smaller concealed carry firearm, the present compact sight 302 has a housing 310 having a width W2 in one embodiment which may not be greater than 0.75 inches to fit the available width of the sight mounting section 403 of the smaller slide. By contrast, the width W1 of housing 110 provided for the larger size slide 202 and firearm previously described herein may be about 0.94 inches. The length L2 of the compact sight housing 310 may be about 5.05 inches, whereas the length L1 of the larger size sight housing 110 may be about 5.8 inches for comparison in some embodiments. The smaller size of the compact sight 302 is thus advantageously easily adaptable to the smaller concealed carry size firearm (e.g., pistol) and its slide due to the omission of an electrically-powered artificial source of illumination such as a light (e.g., LED or other light source).

Due to the smaller size of the sight compact housing 310, the pair lateral side light collection and transmission windows included for larger size sight 102 (see, e.g., windows 120*b* and 120*c*) may be omitted in some embodiments as shown; however, other embodiments of the compact sight may include them. The open top window 120*d* and front window 120*a* may provide sufficient ability alone to collect and illuminate fiber optic element 330 with natural ambient light.

It bears noting that because the compact reflex sight 302 does not include an artificial source of light and associated power source similarly to reflex sight 102 previously described herein, this makes the resultant smaller sight housing 310 highly amenable for use with the smaller size concealed carry pistols 400. This is advantageous for users who desire a dot reticle optical reflex sight for such firearms.

Any suitable metallic and/or non-metallic materials may be used for any of the integrated optical sighting system components described herein based on the purpose of those components.

According to another aspect of the invention, an integral rear sight 500 located forward of the lens may be provided as a backup sighting system which is usable when the dot reticle sight is not in use.

Figure 31:
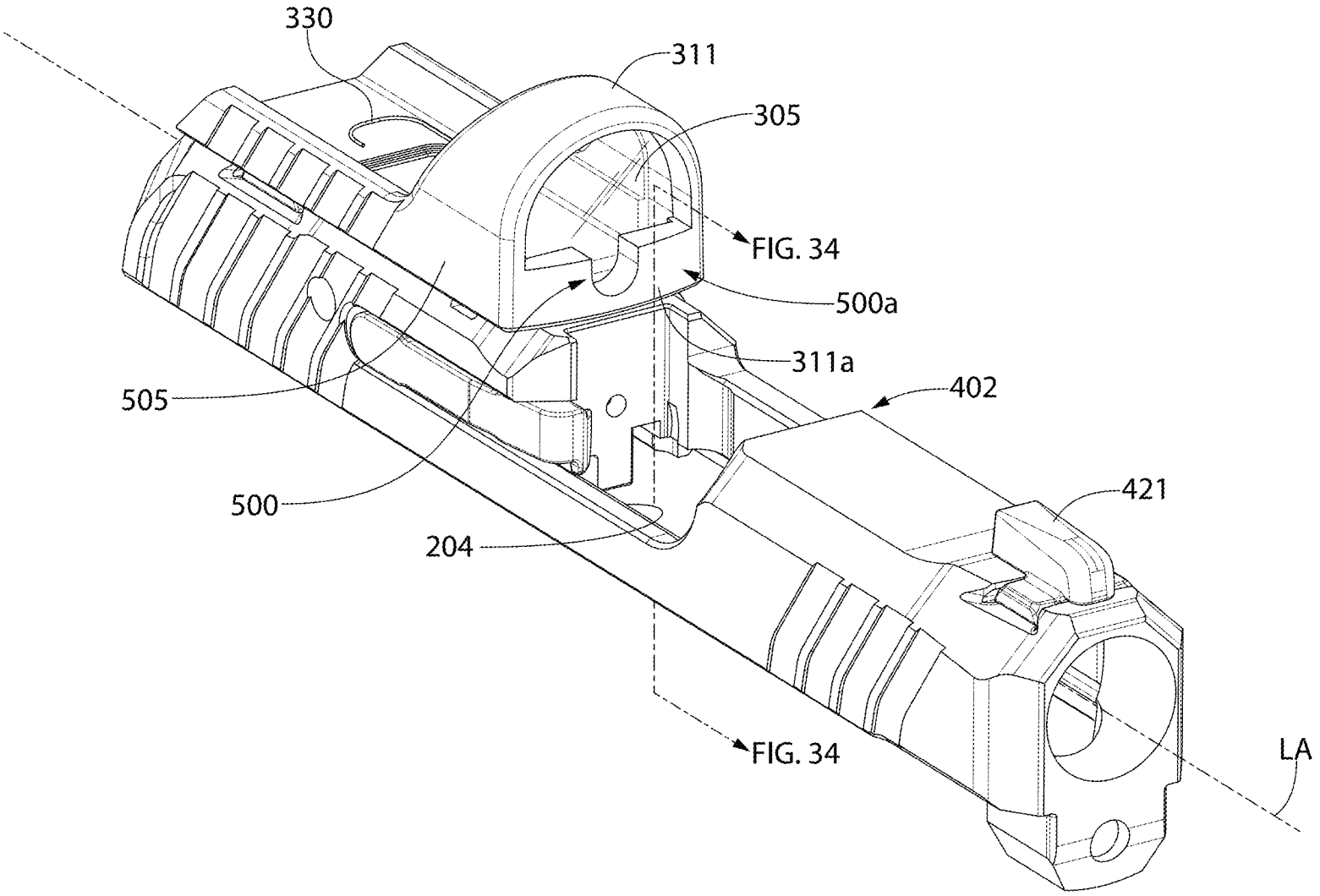
FIG. 31 is a perspective view of the body portion of the firearm of FIG. 17 showing an optional compact optical reflex sight with an integrally-formed rear sight in the lens housing.
Figure 32:
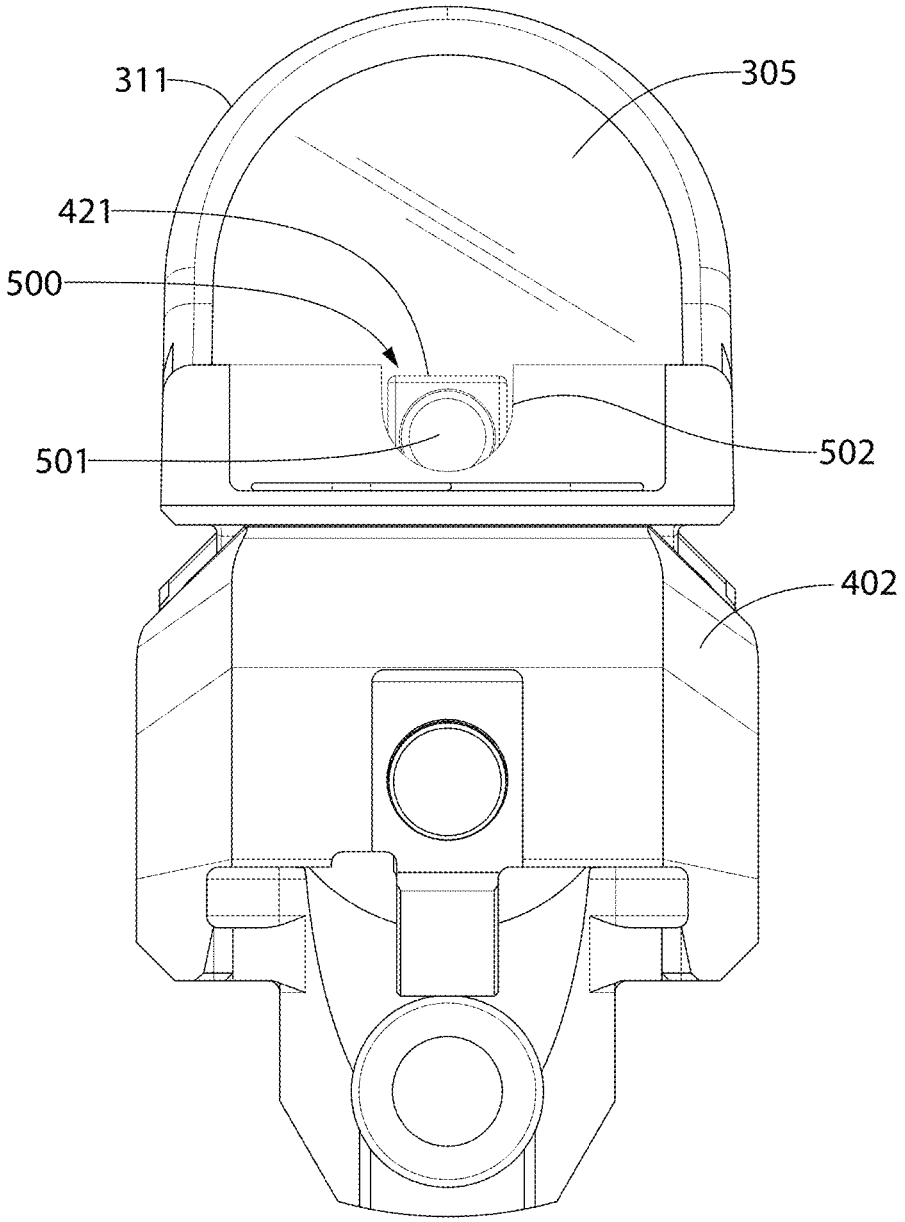
FIG. 32 is a rear view thereof looking forwards.
Figure 33:
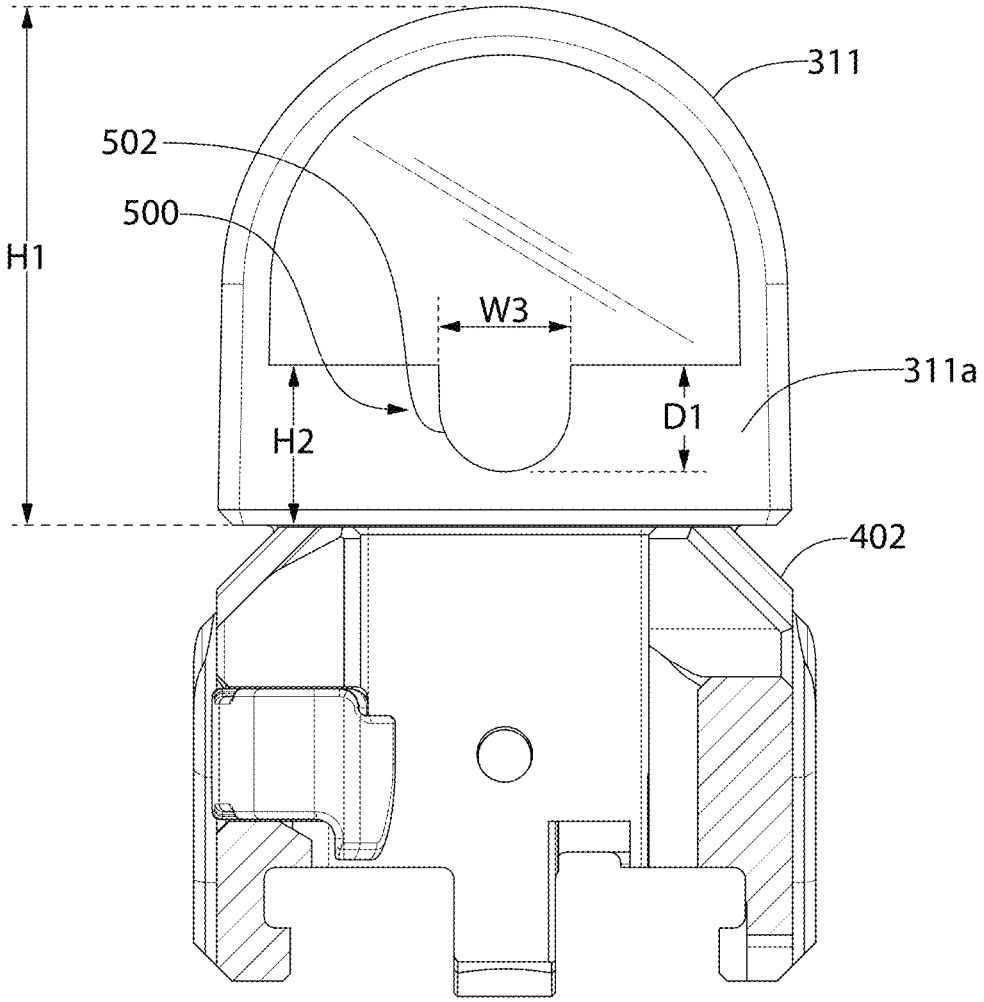
FIG. 33 is a cross sectional view taken from FIG. 31 looking rearward at the integral rear sight.

Referring to FIGS. 31-33, integral rear sight 500 in one embodiment may be located on a forward portion 500*a* of the compact housing 310 of sight 302 in front of lens 305. Rear sight 500 is formed on lens frame portion 311 of the optical reflex sight 302 which supports the lens. In this embodiment, the rearward-located integral rear sight 420 of the optics compact housing 310 previously described herein which was located on rearward portion 500*b* of the housing (see, e.g., FIG. 19) is replaced by the forward-located integral rear sight 500. Similarly to rear sight 420, the forward-located integral rear sight 500 is formed as an integral unitary structural part of the body 505 of the housing 310, thereby advantageously consuming no portion of any available space on slide 402 of the firearm which for a compact pistol is at a premium. The integral rear sights 500 or 420 whichever is provided are the only rear sights on their respective firearms. By contrast, the conventional fixed rear iron sight 220 of a larger full size pistol is typically a separate element mounted directly to the rear end of the slide 202 due to the greater amount of available space to accommodate a separate rear sight (see, e.g., FIG. 1, rear iron sight 220). Some conventional embodiments might also locate the conventional rear iron sight in a more forward position on the slide; but such sights remains as discrete standalone separate elements.

It bears noting that an integral forward or rearward located rear sight as disclosed herein is particularly beneficial and useful for adding optical reflex sighting systems to compact firearms such as compact auto-loading pistols where there is insufficient space on the slide to separately mount a conventional rear iron sight.

With continuing reference to FIGS. 31-33, the present forward-located integral rear sight 500 comprises an upwardly open and generally U-shaped cutout 502 formed in the body 505 of sight housing 310, and more particularly in the transversely and laterally-extending vertical front wall 311*a* of the lens frame portion 311 of the sight housing adjacent to the bottom of lens 305 in one embodiment. The vertical front wall 311*a* of the sight housing 310 extends completely across the front of the housing 310 from side to side of the housing lens frame portion 311 and projects partially upwards for a sufficient vertical distance D2 towards the top of the arched lens frame portion 311 of the housing to permit the cutout 502 to be formed therethrough as shown. The lens 305 is exposed from the front (looking rearward) through the integral rear sight cutout 502 and may adjoin the cutout forming a transparent rear wall thereof. Front wall 311*a* is located towards a bottom of the lens and lens frame portion 311 as shown, and in some embodiment may help provide supports the lens which can be abutted against the wall. Cutout 502 is preferably centered on front wall 311*a* from side to side.

It bears noting that the forward-located integral rear sight 500 of FIGS. 32-34 further advantageously helps to increase the surface area of the reflective surface of the lens 305 (which would increase brightness of the dot reticle). The rear surface of the lens is the reflective surface on which the light is projected to form the reticle. So by moving the integral sight forward in front of the lens, more of that rear lens surface is unobstructed to collect light and generate a brighter reticle reflection. In addition, the front wall 311*a* of the housing lens frame portion 311 advantageously acts as a shield to help deflect gas, debris, and spent casings ejected from the breach area of the firearm through ejection port 204, thereby protecting the lens 305 from carbon fouling and damage. For that purpose and to provide sufficient vertical structure and surface area for forming a functional rear sight 502 therein, front wall 311*a* extends for a vertical height H2 which preferably is at least one-quarter of the height H1 of the front arched housing lens frame portion 311. For example, in one non-limiting embodiment of representative values H1 may be about 0.675 inches and H2 may be about 0.21 inches. Height H1 is measured from bottom of the housing lens frame portion 311 to the highest point on the top of the lens frame portion as shown in FIG. 33.

The bottom of the rear sight cutout 502 may be rounded as shown in some embodiments for more positive alignment by the user of the firearm with the front sight if a circular aiming feature 501 such as a tritium tube/vial is incorporated with the front sight 421 for low ambient light conditions (see, e.g., FIGS. 20 and 32), or for other reasons entirely. In other embodiments, the cutout 502 of the rear sight 500 may be rectilinear such as square or rectangular for alignment with a conventional square profile front sight. Cutout 502 may therefore have various opening shapes which comprise polygonal, non-polygonal, or combinations thereof. The same shape options are applicable to cutout 420*a* of rearward-located rear sight 420 seen in FIGS. 19-21.

Rear sight 500 is longitudinally alignable with the front sight 421 through lens 305 (when looking forward from rear to front of the firearm) for proper aiming at a downfield target. The rear sight cutout 502 has a sufficient vertical depth from top to bottom which is effective for using in aiming via alignment with the front sight. This contrasts to shallow recesses sometimes provided in firearm optics housings forward of the conventional firearm-mounted separate rear sights (see, e.g., FIG. 1) which merely provide clearance to avoid blocking the line of sight of the user between the front and rear sights when used, but cannot function as a practical matter as a rear sight for acquiring a target.

Accordingly, in preferred but non-limiting embodiments cutout 502 of the forward-located rear sight 500 may have a vertical depth D1 which greater than or equal to at least 50% of the width W3 of the cutout, and more preferably greater than or equal to 75% of W3. For example, in one non-limiting embodiment D1 may be about 0.14 inches and W3 may be about 0.17 inches. It bears noting that the same dimensional cutout limitations of depth and width are applicable to rearward-located integral rear sight 420 shown in FIGS. 19-21 as well. Such foregoing cutout dimensional limitations for the rear sight cutout whether in front of or behind lens 305 provide a functional rear sight usable for aiming the firearm.

The integrally-formed rear sight cutout 502 which defines the forward-located rear sight 500, or the integrally-formed rear sight cutout 420*a* which defines rearward-located rear sight 420 (see, e.g., FIG. 18) may be formed during the molding or casting of the optics unit compact housing 310 as a unitary part thereof, or in other embodiments may be machined into the optics housing after formation. The manner in which the integral rear sight is formed does not limit the invention.

Although the top of the housing lens frame portion 311 is shown as being arcuately curved in the non-limiting illustrated embodiment, in other embodiments other profile shapes maybe provided such as rectilinear with straight top from side-to-side, rectilinear with straight top but chamfered on each side to form angle side portions of the lens frame portion, or other shapes. Accordingly, the shape and profile of the housing lens frame portion 311 does not limit the invention and provision of an integral rear sight formed with sight housing.

Although the integrally formed rearwardly-located rear sight 420 or forwardly-located rear sight 500 may be advantageously used to preserve space of the slide of a compact auto-loading pistol, the applicably of using these rear sights is not so limited. Accordingly, these integral rear sights may be used for full size pistols or on long guns (e.g., rifles, carbines, shotguns) which make efficient use of space and simply manufacturing by stark contrast to using conventional separate rear iron sights which require their own special mounting interface to be formed on the slide, thereby increasing manufacturing costs.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An optical unit with integral rear sight for a firearm, comprising:

a housing having a body configured for detachable mounting to the firearm;

a transparent lens supported in an upright position by the housing;

an illumination source supported by the housing and operable to project a reticle on the lens for aiming the firearm; and a rear sight integrally formed in the body of the housing as a unitary part thereof;

wherein the rear sight is axially alignable with a front sight of the firearm viewed through the lens from a rear of the firearm;

wherein the rear sight comprises a cutout formed in a forward portion of the body of the housing in front of the lens; and wherein the cutout is formed in a transversely extending vertical front wall of the housing located towards a bottom of the lens.

2. The optical unit according to claim 1, wherein the rear sight is also viewable through the lens from the rear of the firearm.

3. The optical unit according to claim 2, wherein the lens adjoins a rear of the cutout forming a transparent rear wall thereof.

4. The optical unit according to claim 1 wherein the rear sight comprises a cutout formed in a rearward portion of the body of the housing behind the lens.

5. The optical unit according to claim 1, wherein the cutout has a depth which is greater than or equal to at least 50 percent of a width of the cutout.

6. The optical unit according to claim 5, wherein the cutout the depth of the cutout is greater than or equal to at least 75 percent of the width of the cutout.

7. The optical unit according to claim 1, wherein a bottom of the cutout is rounded.

8. The optical unit according to claim 1, wherein the rear sight is mounted to a reciprocating slide of the firearm immediately adjacent to and rearward of a cartridge ejection port.

9. The optical unit according to claim 1, wherein the illumination source comprises a fiber optic element supported in the housing, the fiber optic element configured and operable to absorb ambient light and project the reticle on the lens.

10. The optical unit according to claim 9, further comprising a light-transmissible cover enclosing the fiber optic element.

11. An optical unit with integral rear sight for a firearm, comprising:

a housing having a body configured for detachable mounting to the firearm;

a transparent lens supported in an upright position by the housing;

an illumination source supported by the housing and operable to project a reticle on the lens for aiming the firearm; and a rear sight integrally formed in the body of the housing as a unitary part thereof;

wherein the rear sight is axially alignable with a front sight of the firearm viewed through the lens from a rear of the firearm;

wherein the illumination source comprises a fiber optic element supported in the housing, the fiber optic element configured and operable to absorb ambient light and project the reticle on the lens; and wherein the cover and fiber optic element are in communication with a plurality of windows formed in the housing which collect and transmit the ambient light to the fiber optic element.

12. The optical unit according to claim 11, wherein the housing defines an upwardly open light-gathering cavity which receives the fiber optic element and cover.

13. The optical unit according to claim 12, wherein the housing comprises a longitudinally elongated base portion which defines the cavity and is configured for mounting to a sight mounting section of the firearm.

14. The optical unit according to claim 10, wherein the reticle is formed by light transmitted and projected onto the lens from a light-emitting terminal end of the fiber optic element.

15. The optical unit according to claim 14, wherein the fiber optic element comprises a light-absorbing circuitous portion and a contiguously formed light-emitting end section aimed at the lens.

16. The optical unit according to claim 1, wherein the reticle is dot-shaped.

17. The optical unit according to claim 1, wherein the housing has a maximum width of 0.75 inches for a compact firearm.

18. The optical unit according to claim 1, wherein the rear sight integrally formed in the body of the housing sighting system is the only rear sight of the firearm.

* * * * *